US012740621B2

(12) United States Patent
Sagara

(10) Patent No.: US 12,740,621 B2
(45) Date of Patent: Sep. 22, 2026

(54) POLYESTER-BASED WOVEN HOOK-AND-LOOP FASTENER AND PRODUCTION METHOD THEREFOR

(71) Applicant: Kuraray Fastening Co., Ltd., Osaka (JP)

(72) Inventor: Makoto Sagara, Sakai (JP)

(73) Assignee: KURARAY FASTENING CO., LTD., Osaka (JP)

( * ) Notice: Subject to any disclaimer, the term of this patent is extended or adjusted under 35 U.S.C. 154(b) by 120 days.

(21) Appl. No.: 18/860,430

(22) PCT Filed: Apr. 6, 2023

(86) PCT No.: PCT/JP2023/014237

§ 371 (c)(1),
(2) Date: Oct. 25, 2024

(87) PCT Pub. No.: WO2023/210293

PCT Pub. Date: Nov. 2, 2023

(65) Prior Publication Data

US 2025/0288066 A1 Sep. 18, 2025

(30) Foreign Application Priority Data

Apr. 26, 2022 (JP) ..... 2022-072329

(51) Int. Cl.
*A44B 18/00* (2006.01)

(52) U.S. Cl.
CPC ..... *A44B 18/0034* (2013.01)

(58) Field of Classification Search
CPC ..... A44B 18/0034; A44B 18/0038; A44B 18/003; A44B 18/0023; A44B 18/0026
See application file for complete search history.

(56) References Cited

U.S. PATENT DOCUMENTS

2008/0289157 A1 11/2008 Higashinaka et al.
2014/0230123 A1 8/2014 Kaikou et al.
2022/0061470 A1* 3/2022 Tanikawa ..... A44B 18/008

FOREIGN PATENT DOCUMENTS

JP 2013-244139 12/2013
JP 2015-62600 4/2015
(Continued)

OTHER PUBLICATIONS

European Search Report for EP Patent Application No. 23796039.8 issued on Feb. 23, 2026, 7 pages.
(Continued)

*Primary Examiner* — Jack W Lavinder
(74) *Attorney, Agent, or Firm* — Grüneberg Global IP, PLLC

(57) ABSTRACT

A polyester-based woven hook-and-loop fastener including: a woven-fabric and engaging elements, in which the woven-fabric in which a polyethylene terephthalate-based multifilament yarn is a warp yarn and a polyester-based heat-fusible multifilament yarn is a weft yarn is a woven base fabric, a yarn for the engaging elements made of at least one kind selected from the group consisting of a polyethylene terephthalate-based monofilament yarn and a polyester-based multifilament yarn, is woven in parallel to the warp yarn into the woven base fabric, the engaging elements that are formed of the yarn for the engaging elements, that are made of at least one kind selected from the group consisting of a large number of hook shapes and loop shapes, and that rise up from a front face of the woven base fabric, exist on the front face of the woven base fabric, bases of the engaging elements are fixed to the woven base fabric by a melt-solidified material of a heat-fusible component of the polyester-based heat-fusible multifilament yarn, and the polyethylene terephthalate-based multifilament yarn is made of a copolymerized polyethylene terephthalate containing, as
(Continued)

copolymerization components, 1.0 to 2.0 mol % of isophthalic acid with respect to a total amount of dicarboxylic acids and 2.0 to 3.5 mol % of diethylene glycol with respect to a total amount of diols.

13 Claims, 2 Drawing Sheets

(56) References Cited

FOREIGN PATENT DOCUMENTS

| | | |
|---|---|---|
| JP | 2017-196028 A | 11/2017 |
| WO | 2005/122817 | 12/2005 |

OTHER PUBLICATIONS

International Search Report received for PCT Application No. PCT/JP2023/014237, mailed on Jun. 27, 2023, 5 pages with English translation.
Written Opinion received for PCT Application No. PCT/JP2023/014237, mailed on Jun. 27, 2023, 6 pages with English translation.

* cited by examiner

POLYESTER-BASED WOVEN HOOK-AND-LOOP FASTENER AND PRODUCTION METHOD THEREFOR

CROSS-REFERENCE TO RELATED APPLICATIONS

This application is a National Stage entry under § 371 of International Application No. PCT/JP2023/014237, filed on Apr. 6, 2023, and which claims the benefit of priority to Japanese Patent Application No. 2022-072329, filed on Apr. 26, 2022. The content of each of these applications is hereby incorporated by reference in its entirety.

TECHNICAL FIELD

The present invention is a woven hook-and-loop fastener in which a warp yarn is made of polyethylene terephthalate (hereinafter sometimes abbreviated as PET)-based yarn, and is the woven-fabric-based woven hook-and-loop fastener (hereinafter, sometimes simply referred to as a hook-and-loop fastener) in which polyester-based heat-fusible multifilament yarn is used as a weft yarn, bases of engaging elements are fixed to a woven base fabric of the hook-and-loop fastener by fusion of the heat-fusible multifilament yarn, hook-shaped engaging elements are less likely to be pulled out from the woven base fabric even when engagement and the peeling are repeated, the engaging elements are fixed to the woven base fabric so as not to be pulled out, and it is capable of being easily dyed in a deep color with a disperse dye. Further, preferably, the present invention relates to a polyester-based woven-fabric hook-and-loop fastener which satisfies the above-described excellent pull-out resistance and dyeability, and in addition, and in which, in a heat treatment step for fusing the above-described heat-fusible multifilament yarn, the yarn constituting the hook-and-loop fastener is less likely to cause the uneven heat shrinkage, and as a result, the hook-and-loop fastener is less likely to cause waving in the up-and-down direction, and by the less waving, when the engaging elements are hook-shaped engaging elements, the cut position of one leg is constant and when the engaging elements are loop-shaped engaging elements, a uniform engaging force due to the less waving is provided, and a method for producing the same.

BACKGROUND ART

Conventionally, as a hook-and-loop fastener having a woven base fabric, a combination of a so-called woven-fabric-based hook hook-and-loop fastener including a large number of hook-shaped engaging elements made of a monofilament yarn on the front face of a woven base fabric and a so-called woven-fabric-based loop hook-and-loop fastener including a large number of loop-shaped engaging elements made of a multifilament yarn capable of engaging with the hook-shaped engaging elements on the front face of a woven base fabric has been widely used in application fields such as clothes and daily sundries because the engaging elements tend to have less damage or the like and reducing of the engaging force is less even when the engagement and the peeling are repeated.

In addition, a so-called hook-and-loop coexisting type woven-fabric-based hook-and-loop fastener including both of a large number of the hook-shaped engaging elements and a large number of the loop-shaped engaging elements on the same front face of a woven base fabric is also widely used because one kind of hook-and-loop fastener has both the functions of the hook-and-loop fastener of a hook hook-and-loop fastener and a loop hook-and-loop fastener, so that it is not necessary to use both of the hook hook-and-loop fastener and the loop hook-and-loop fastener in combination, unlike a conventional hook-and-loop fastener.

Such a woven-fabric-based hook-and-loop fastener is produced by, at the time of weaving the woven base fabric, weaving a yarn for the engaging elements in parallel to a warp yarn in the woven base fabric such that the yarn for the engaging elements is protruded in a loop shape from the front face of the woven base fabric in some places, fixing the loop shape by heating, and then cutting one leg of the loop to form hook-shaped engaging elements from loops in the case where the engaging elements are hook-shaped engaging elements, or without cutting one leg in the case where the engaging elements are loop-shaped engaging elements. In order to prevent the yarn for the engaging elements woven in parallel to the woven base fabric made of the warp yarn and weft yarn from being pulled out from the woven base fabric by a pulling force at the time of peeling the engagement, usually, a urethane-based or acrylic-based resin agent called a back coating adhesive is applied to a rear face of the woven base fabric.

However, when the back coating adhesive liquid is applied to the rear face of the woven base fabric and dried, the organic solvent used in the adhesive liquid deteriorates the working environment, in the case of collecting the organic solvent, the apparatus therefor is required, and a step, an apparatus, and time are further required for drying the adhesive liquid. As a result, productivity is lowered, and it is necessary to periodically remove the adhesive attached to the apparatus during coating and drying, which also reduces productivity.

In addition, the hook-and-loop fastener coated with the back coating adhesive liquid tends to lose the flexibility of the woven base fabric due to the adhesive layer existing on the rear face of the woven base fabric and become stiff. Therefore, there is a disadvantage that the flexible texture of the woven-fabric or the like to which the hook-and-loop fastener is attached is lowered and the air permeability of the hook-and-loop fastener is lowered due to the adhesive layer.

Further, in the case where the back coating adhesive liquid is applied to the rear face of the woven base fabric, when such woven-fabric hook-and-loop fastener is dyed, the dye liquid cannot penetrate the woven base fabric because of the adhesive layer existing on the rear face of the woven base fabric, so that uniform and deep color dyeing cannot be achieved. For this reason, it is necessary to dye before applying the back coating adhesive liquid. When dyeing is performed before the back coating adhesive liquid is applied, dyeing is performed in a state in which the yarn for the engaging elements or the like is not fixed to the woven base fabric. Therefore, movement such as misalignment of the yarn constituting the woven base fabric or the like occurs during the dyeing treatment, and the alignment of the engaging elements is disordered. Further, in the case where the engaging elements are hook-shaped engaging elements, when the alignment of the loops for the engaging elements is disordered, at the time of cutting one leg of the loop for the engaging elements to form hook-shaped engaging elements thereafter, it is difficult to surely cut only one leg, and there exist cases in which both legs are cut, cases in which both legs are not cut and cases in which one leg is cut only partway.

Moreover, in the case of a hook-and-loop fastener having a back coating adhesive layer on the rear face, it is necessary to be dyed during production. For this reason, in order to quickly meet the color demand of the user, it is necessary to prepare hook-and-loop fasteners of many colors in advance, which naturally leads to an increase in the amount of stock and requires manpower and cost for storage and management.

As a hook-and-loop fastener for solving the above-mentioned problems of the hook-and-loop fastener having a back coating adhesive layer, PTL 1 describes a hook-and-loop fastener made of a warp yarn, a weft yarn containing a heat-fusible multifilament yarn, and a yarn for the engaging elements, in which polyester-based yarns are used as all the warp yarn, the weft yarn, and the yarn for the engaging elements, and the heat-fusible multifilament yarn used as the weft yarn is fused and by the heat shrinkage of these yarns, the yarn for the engaging elements is fixed to the woven base fabric.

Further, PTL 2 also describes a combination of: a hook hook-and-loop fastener in which a large number of hook-shaped engaging elements formed of a PET yarn for the hook-shaped engaging elements woven in parallel to the warp yarn rise up on one face of a woven base fabric formed of a polyester-based warp yarn and a polyester-based weft yarn, and the bases of the hook-shaped engaging elements are fixed to the woven base fabric by fusion of the heat-fusible multifilament yarn used as the weft yarn; and a loop hook-and-loop fastener in which a large number of loop-shaped engaging elements formed of a polybutylene terephthalate (hereinafter, abbreviated as PBT)-based yarn for the loop-shaped engaging elements woven in parallel to the warp yarn rise up on one face of the woven base fabric formed of a polyester-based warp yarn and a polyester-based weft yarn, and the bases of the loop-shaped engaging elements are fixed to the woven base fabric (hereinafter, simply referred to as a base fabric in some cases) by fusion of the heat-fusible multifilament yarn used as the weft yarn.

Certainly, when the method of fixing the bases of the engaging elements by using the heat-fusible multifilament yarn described in these documents is used, the above-described many problems caused by the use of the back coating adhesive liquid can be solved. However, the fixing of the bases of the engaging elements using the heat-fusible multifilament yarn is insufficient. In order to supplement the fixation of the bases of the engaging elements, these PTLs describe a method in which yarns which shrink at a high temperature are used as the warp yarn, the weft yarn, and the yarn for the engaging elements constituting the hook-and-loop fastener, and the bases of the engaging elements are tightened to the base fabric by the heat shrinkage of the warp yarn, the weft yarn and the yarn for the engaging elements.

However, it has been found that, regarding the fixing of the engaging elements by the fusion by the heat-fusible multifilament yarn and by the heat shrinkage of the warp yarn, the weft yarn and the yarn for the engaging elements, as described in these literature, the fixing is still insufficient, therefore a phenomenon occurs in which the fixing of the engaging elements is released and the engaging elements are pulled out from the front face of the hook-and-loop fastener as the engagement and the peeling are repeated. Further, it has been found that, when the heat shrinkage of the yarn constituting the woven-fabric is increased in order to prevent the engaging elements from being pulled out from the front face the woven-fabric, the flexibility of the woven-fabric hook-and-loop fastener is impaired, therefore the flexibility of the hook-and-loop fastener obtained by not applying a back coating resin layer to the rear face is reduced.

In addition, it has been found that, such a polyester-based hook-and-loop fastener is dyed with disperse dyes, and in the hook-and-loop fastener dyed as described above, the dye does not sufficiently reach the inside of the yarn constituting the hook-and-loop fastener base fabric due to the shrinkage of constituent yarns, and when the hook-and-loop fastener is cut, an insufficiently dyed cross-sectional part is exposed, in particular, with respect to the hook-shaped engaging elements, a phenomenon occurs in which a surface of the monofilament yarn is worn or peeled as the engagement and the peeling are repeated, so that the inner layer which is hardly dyed is exposed, and the presence of the whitish engaging elements on the front face of the hook-and-loop fastener becomes conspicuous.

CITATION LIST

Patent Literature

PTL 1: WO2005/122817
PTL 2: JP2013-244139

SUMMARY OF INVENTION

Technical Problem

The present inventors intend to provide a polyester-based woven-fabric hook-and-loop fastener in which it is less likely to cause the engaging elements to be pulled out from the base fabric even when the engagement and the peeling are repeated, in which the base fabric has flexibility in spite of the engaging elements being less likely to be pulled out from the base fabric, and which can be easily dyed in a deep color with a disperse dye, by ameliorate the above described problems of the woven-fabric-based hook-and-loop fastener obtained by fusing the heat-fusible multifilament yarn used as the weft yarn to fix the yarn for the engaging elements to the woven base fabric of the hook-and-loop fastener described in the above PTLs.

Further, preferably, it is an object to provide a polyester-based woven hook-and-loop fastener having no back coating adhesives, in which the hook-and-loop fastener is less likely to cause waving in the up-and-down direction or the like due to occurrence of non-uniform shrinkage of the yarn constituting the hook-and-loop fastener in the heat treatment step for fusing the heat-fusible multifilament yarn or the dyeing step of the hook-and-loop fastener.

Solution to Problem

That is, the present invention is a polyester-based woven hook-and-loop fastener including: a woven-fabric and engaging elements, in which the woven-fabric in which a PET-based multifilament yarn is a warp yarn and a polyester-based heat-fusible multifilament yarn is a weft yarn, is a woven base fabric, a yarn for the engaging elements made of at least one kind selected from the group consisting of a PET-based monofilament yarn and a polyester-based multifilament yarn is woven in parallel to the warp yarn into the woven base fabric, the engaging elements that are formed of the yarn for the engaging elements, that are made of at least one kind selected from the group consisting of a large number of hook shapes and loop shapes, and that rise up from a front face of the woven base fabric, exist on the front face of the woven base fabric, bases of the engaging elements are fixed to the woven base fabric by a melt-solidified material of a heat-fusible component of the the polyester-based heat-fusible multifilament yarn, and the PET-based multifilament yarn is made of a copolymerized PET containing, as copolymerization components, 1.0 to 2.0 mol % of isophthalic acid (hereinafter, abbreviated as IPA in some cases) with respect to a total amount of dicarboxylic acids and 2.0 to 3.5 mol % of diethylene glycol (hereinafter, abbreviated as DEG in some cases) with respect to a total amount of diols.

Additionally, preferably, in such a polyester-based woven hook-and-loop fastener, when the yarn for the engaging elements is a monofilament yarn, the engaging elements formed of the monofilament yarn are hook-shaped engaging elements, and when the yarn for the engaging elements is a multifilament yarn, the engaging elements formed of the multifilament yarn are loop-shaped engaging elements. Further, preferably, when the yarn for the engaging elements is a monofilament yarn, the monofilament yarn is made of a copolymerized PET containing, as copolymerization components, 1.0 to 2.0 mol % of IPA with respect to a total amount of dicarboxylic acids and 2.0 to 3.5 mol % of DEG with respect to a total amount of diols. Moreover, preferably, when the yarn for the engaging elements is a multifilament yarn, as the multifilament yarn, a multifilament yarn made of a PET-based or PBT-based polyester is used.

Further, preferably, in the polyester-based woven hook-and-loop fastener, the woven base fabric satisfies a thickness of the warp yarn, which alternately runs over and under the weft yarn with the weft yarn interposed therebetween, in a base fabric thickness direction of the woven-fabric at a position at which the warp yarn subducts most toward a rear face side being 0.94 times or less of a thickness of the warp yarn in the base fabric thickness direction of the woven-fabric at a position at which the warp yarn floats most toward a front face side.

Further, preferably, such a polyester woven hook-and-loop fastener is dyed with a disperse dye.

In addition, the present invention is a method for producing a polyester-based woven hook-and-loop fastener, the polyester-based woven hook-and loop fastener including: a woven-fabric and engaging elements, in which the woven-fabric in which a polyethylene terephthalate-based multifilament yarn is a warp yarn and a polyester-based heat-fusible multifilament yarn is a weft yarn is a woven base fabric, a yarn for the engaging elements made of at least one kind selected from the group consisting of a polyethylene terephthalate-based monofilament yarn and a polyester-based multifilament yarn is woven in parallel to the warp yarn into the woven base fabric, the engaging elements that are formed of the yarn for the engaging elements, that are made of at least one kind selected from the group consisting of a large number of hook shapes and loop shapes, and that rise up from a front face of the woven base fabric exist on the front face of the woven base fabric, and step A, step B, and step C described below are performed in this order, and the multifilament yarn made of a copolymerized PET containing, as copolymerization components, 1.0 to 2.0 mol % of IPA with respect to a total amount of dicarboxylic acids and 2.0 to 3.5 mol % of DEG with respect to a total amount of diols is used as the warp yarn.

[step A] a step of weaving a loop woven-fabric by, at a time of weaving the woven base fabric from the warp yarn and the weft yarn, weaving the yarn for the engaging elements parallel into the warp yarn, and at the same time, regularly raising the yarn for the engaging elements in a loop shape from the front face of the woven base fabric;

[step B] a step of guiding the loop woven-fabric to a heating region, heating at a temperature equal to or higher than a temperature at which a heat-fusible component of the polyester-based heat-fusible multifilament yarn is melted, and fixing a rising part of a loop to the woven base fabric by a melt from the polyester-based heat-fusible multifilament yarn;

[step D] a step of cutting one leg of the loop to form loops into hook-shaped engaging elements when the loop is made of a monofilament yarn.

Moreover, preferably, in such a method for producing the polyester-based woven hook-and-loop fastener, when the yarn for the engaging elements is a monofilament yarn, the monofilament yarn made of a copolymerized PET containing, as copolymerization components, 1.0 to 2.0 mol % of IPA with respect to a total amount of dicarboxylic acids and 2.0 to 3.5 mol % of DEG with respect to a total amount of diols is used. Further, preferably, when the yarn for the engaging elements is a multifilament yarn, the multifilament yarn is made of a PET-based or PBT-based polyester.

Also, preferably, in such a method for producing the polyester-based woven hook-and-loop fastener, step C described below is performed between the above step B and the above step D:

[step C] a step of taking out the woven base fabric from the heating region of step B and pressing a rear face of the woven base fabric against a fixed surface or a roll surface in a state in which the heat-fusible component of the polyester-based heat-fusible multifilament yarn is melted.

Further preferably, in such a method for producing the polyester-based woven hook-and-loop fastener, [step C] is performed by a method in which while pressing the rear face of the woven base fabric against the fixed surface, the woven base fabric is allowed to run while sliding on the surface and a running direction of the woven base fabric is changed on the fixed surface. Further, the above [step C] is performed at a temperature lower than a temperature of [step B] by utilizing a residual heat of [step B], following [step B] without once cooling the woven base fabric taken out from [step B].

Additionally, preferably, a dyed polyester-based woven hook-and-loop fastener is produced, in which the polyester-based woven hook-and-loop fastener obtained by such a method for producing the polyester-based woven hook-and-loop fastener is dyed with a disperse dye.

Advantageous Effects of Invention

In the woven hook-and-loop fastener of the present invention, the PET-based multifilament yarn constituting the warp yarn (sometimes abbreviated as PET-based multifilament yarn) is formed of PET in which a specific amount of IPA is copolymerized as a part of dicarboxylic acids constituting PET, and further DEG is copolymerized as a part of a diol component constituting PET in an amount larger than that generated in usual PET polymerization, as compared with the PET-based multifilament yarn constituting the warp yarn in the conventional the hook-and-loop fastener.

That is, the PET-based yarn (multifilament yarn and monofilament yarn) constituting a conventional hook-and-loop fastener is usually obtained by using terephthalic acid as a dicarboxylic acid and ethylene glycol as a diol, subjecting the dicarboxylic acid and the diol to condensation polymerization to obtain a PET homopolymer, melting the PET homopolymer, extruding the melted product from a nozzle, and stretching and heat-treating (heat-setting) the resultant product. In such a yarn, unless there is a special reason, IPA is not copolymerized, and DEG is naturally generated during polymerization, but the amount thereof is about 1 to 1.5 mol % with respect to the total amount of the diols.

In contrast, the PET-based multifilament yarn forming the warp yarn constituting the hook-and-loop fastener of the present invention contains IPA as a specific amount copolymerization component, and further contains DEG in an amount larger than the amount in which DEG is naturally generated. Since the warp yarn is made of such a special yarn, the heat-fusion and the adhesive strength by the heat-fusion can be enhanced, the bases of the hook-shaped engaging elements are firmly fixed to the woven base fabric, and the hook-shaped engaging elements can be made less likely to be pulled out from the hook-and-loop fastener base fabric even when the engagement and the peeling are repeated.

Further, since the warp yarn is made of such a special yarn, the yarn can be largely shrunk in the heat-fusion treatment step, and also in this respect, the yarn for the engaging elements can be firmly fixed to the base fabric by the fusion component.

In addition, since such a special PET-based multifilament yarn is used in the warp yarn, even the inside of the multifilament yarn can be uniformly dyed in a deep color by an ordinary dyeing treatment with a disperse dye. Since the cross section of the hook-and-loop fastener is uniformly dyed in a deep color when the dyed hook-and-loop fastener is slit and used, the woven hook-and-loop fastener excellent in appearance is obtained. In particular, in the case of a thick monofilament yarn for the hook-shaped engaging elements, the effect capable of being dyed in a deep color is even greater.

When the IPA is copolymerized with the PET, the dyeability and the pull-out resistance of the engaging elements of the hook-and-loop fastener obtained by using such IPA-copolymerized PET as the warp yarn are enhanced as the copolymerization amount of the IPA increases. However, on the other hand, when the copolymerization amount is increased, the warp yarn tends to have single yarn breakage or fluffing at the time of weaving the hook-and-loop fastener, and as a result, it becomes difficult to obtain a commercially valuable hook-and-loop fastener. Further, when a PET yarn in which DEG is present in an amount larger than the amount naturally generated in a usual condensation polymerization reaction is used as a warp yarn, it is possible to suppress the occurrence of single yarn breakage or fluffing of the warp yarn.

Additionally, in the case where the woven hook-and-loop fastener of the present invention is a hook-and-loop fastener having hook-shaped engaging elements, by using the PET-based monofilament yarn in which the amount of IPA and the amount of DEG specified in the present invention are copolymerized not only as the warp yarn but also as the yarn for the hook-shaped engaging elements, it is possible to obtain a hook-and-loop fastener having hook-shaped engaging elements in which the effect of the present invention is further enhanced.

Furthermore, in general, when a yarn having a high heat shrinkage percentage is used, the resultant hook-and-loop fastener tends to cause uneven shrinkage of the shrinkable yarn in the heat-fusion treatment step. As a result, the hook-and-loop fastener is likely to cause rise and sink in the up-and-down direction (so-called waving). The waving of the hook-and-loop fastener in the up-and-down direction caused by the non-uniform shrinkage leads to a non-uniform engaging force in the case of a loop hook-and-loop fastener. In particular, in the case of a hook hook-and-loop fastener, it is difficult to surely cut only a certain position of one leg of the loop for the hook-shaped engaging elements to form hook-shaped engaging elements.

Further, a hook-and-loop fastener having a waving in the up-and-down direction tends to cause a problem that, in a high temperature and high pressure dyeing treatment using a usual disperse dye, a drift of a dyeing liquid occurs and it becomes difficult to obtain a dyed product uniformly dyed in a deep color. In particular, in the woven hook-and-loop fastener of the present invention, a highly shrinkable yarn is used for the warp yarn or the like in order to highly prevent the engaging elements from being pulled out, so that a waving is likely to occur in the up-and-down direction. However, in the present invention, the problem of the waving in the up-and-down direction due to non-uniform shrinkage is solved by performing the step C immediately after the heat-fusion treatment step B.

DESCRIPTION OF EMBODIMENTS

Figure 1:
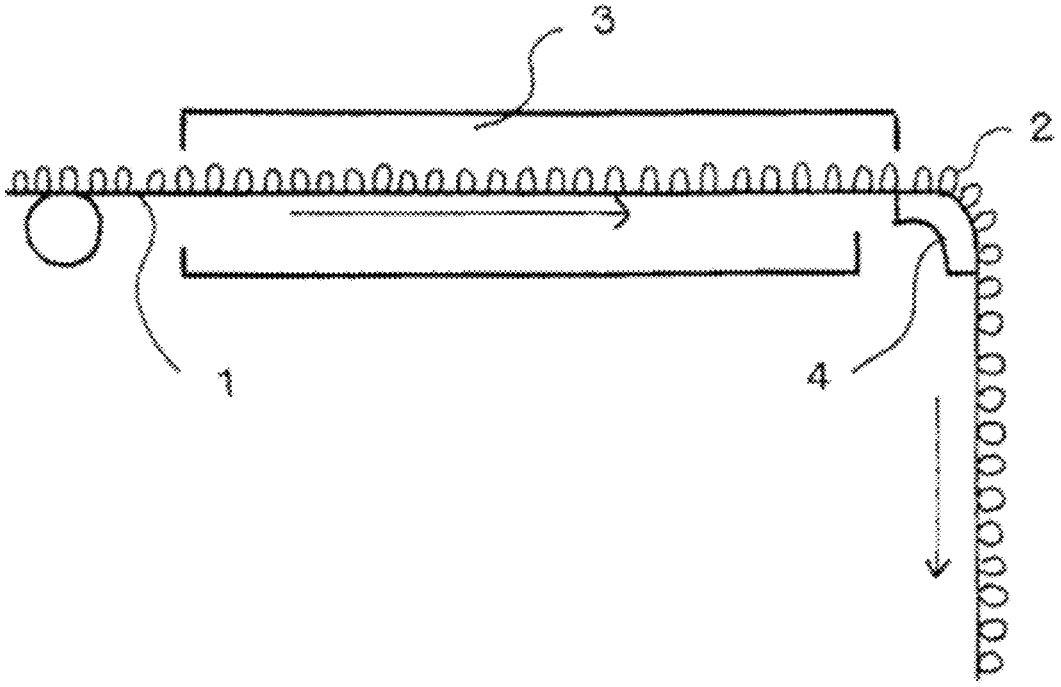
FIG. 1 is a view schematically showing an example of a heat treatment apparatus used in the heat treatment suitably used in the production of the woven hook-and-loop fastener according to the present invention.

Hereinafter, the present invention is explained in detail. First, the polyester-based woven hook-and-loop fastener having the hook-shaped engaging elements of the present invention is roughly classified into three types: a hook hook-and-loop fastener in which only hook-shaped engaging elements are present on a front face of the woven base fabric, a loop hook-and-loop fastener in which only loop-shaped engaging elements are present on a front face of the woven base fabric, and a hook-and-loop coexisting type hook-and-loop fastener in which both hook-shaped engaging elements and loop-shaped engaging elements coexist on a front face of the woven base fabric.

Among these, the hook hook-and-loop fastener is mainly formed of a monofilament yarn for hook-shaped engaging elements, a multifilament yarn for a warp yarn, and a multifilament for a weft yarn. Further, the loop hook-and-loop fastener is mainly formed of a multifilament yarn for loop-shaped engaging elements, a multifilament yarn for a warp yarn, and a multifilament yarn for a weft yarn. Moreover, the hook-and-loop coexisting type hook-and-loop fastener in which the hook-shaped engaging elements and the loop-shaped engaging elements coexist on the same front face is mainly formed of a monofilament yarn for the hook-shaped engaging elements, a multifilament yarn for the loop-shaped engaging elements, a multifilament yarn for the warp yarn, and a multifilament yarn for the weft yarn. Further, when necessary, a small amount of yarn other than the above-described yarns can be woven into the hook-and-loop fasteners, or no yarn other than the above-described yarns can be woven thereinto.

In the present invention, the warp yarn and the weft yarn are required to be substantially made of a polyester-based polymer in order to prevent the occurrence of a waving due to water absorption and moisture absorption as in the woven hook-and-loop fastener in which the polyamide-based fibers are used, to firmly bond the yarns to each other by heat-fusion, to prevent the yarns from yellowing in the heat-fusion step, and to simultaneously dye the attached hook-and-loop fastener in the same color when clothes, daily sundries, and the like are dyed since polyester-based fibers are used for all of these products. From this point of view, it is preferable that the warp yarn, the weft yarn, and the yarn for the engaging elements are substantially made of a polyester-based resin.

Specifically, a multifilament yarn made of PET is used for the warp yarn and, preferably, a monofilament yarn made of PET is used for the yarn for the hook-shaped engaging elements, since the above requirements can be achieved to a high degree. Further, preferably, a multifilament yarn made of a PET-based or PBT-based polyester, more preferably a multifilament yarn made of a PBT-based polyester, is used for the yarn for the loop-shaped engaging elements, and a polyester-based multifilament yarn is also used for the weft yarn.

For the warp yarn, a PET-based yarn made of a polymer having an ethylene terephthalate unit as a main repeating unit is used. In the present invention, IPA and DEG are added as specific amount copolymerization components in addition to the terephthalic acid and ethylene glycol in the warp yarn, and a yarn made of a copolymerized PET, which is a polymer obtained by a condensation reaction thereof, is used. The content of IPA is 1.0 to 2.0 mol % with respect to the total amount of dicarboxylic acids, and the content of DEG is 2.0 to 3.5 mol % with respect to the total amount of diols constituting the obtained copolymerized PET.

When the copolymerization amount of IPA is within the above range, the bases of the hook-shaped engaging elements are firmly fixed to the woven base fabric without lowering the adhesive strength due to the heat-fusion and the heat shrinkage, the hook-shaped engaging elements are less likely to be pulled out from the hook-and-loop fastener base fabric by repetition of the engagement and the peeling, and the inside of the multifilament yarn can be uniformly dyed in a deep color by an ordinary dyeing treatment with a disperse dye.

When the copolymerization amount of IPA is lower than the above-described range, the adhesive strength due to the heat-fusion and the heat shrinkage is lowered, it is difficult to firmly fix the bases of the hook-shaped engaging elements to the woven base fabric, and the hook-shaped engaging elements tend to be pulled out from the hook-and-loop fastener base fabric by repetition of the engagement and the peeling. Further, it is difficult to uniformly dye the multifilament yarn in a deep color to the inside thereof by an ordinary dyeing treatment with a disperse dye.

On the other hand, when the copolymerization amount of IPA exceeds the above-described range, a multifilament yarn made of a fine filament is used as the warp yarn in order to enhance the flexibility and the fusion-fixing property with the weft yarn. However, in the weaving step of the hook-and-loop fastener, a surface of the warp yarn made of such a thin filament is abraded by the up-and-down movement of the heddle and the insertion of the weft yarn, so that the single yarn breakage and fluffing of the warp yarn tend to occur, and the commercial value of the hook-and-loop fastener having the single yarn breakage and fluffing is largely lowered, and as a result, it becomes difficult to obtain a commercially valuable hook-and-loop fastener. The occurrence of the single yarn breakage and fluffing can be improved at a certain degree by increasing the copolymerization amount of DEG in the warp yarn. However, when the copolymerization amount of IPA is increased, the effect of DEG cannot be compensated.

That is, when the copolymerization amount of IPA is within the above range, it is not necessary to use a multifilament yarn made of a fine filament as the warp yarn in order to enhance flexibility and fusion-fixing property with the weft yarn, and in the weaving step of the hook-and-loop fastener, the surface is not abraded by the up-and-down movement of the heddle or the insertion of the weft yarn, the single yarn breakage or fluffing of the warp yarn do not occur, so that a commercially valuable hook-and-loop fastener can be easily obtained.

Additionally, when the amount of DEG is less than the above-described range, it is difficult to prevent the occurrence of the single yarn breakage and fluffing of the warp yarn by the IPA copolymerization. On the other hand, when the amount is too large, the effect of preventing the occurrence of the single yarn breakage and fluffing of the warp yarn due to the IPA copolymerization cannot be further improved, and rather, the properties of the PET yarn such as excellent mechanical properties are impaired, resulting in a decrease in the engaging force.

That is, when the amount of DEG is within the above-described range, it is possible to prevent the occurrence of the single yarn breakage and fluffing of the warp yarn due to the IPA copolymerization, the effect of preventing the occurrence of the single yarn breakage and fluffing of the warp yarn due to the IPA copolymerization is obtained, the properties of the PET yarn such as excellent mechanical properties are not impaired, and the engaging force is not reduced.

From the above, in the polyester-based woven hook-and-loop fastener of the present invention, it is necessary that both of the above-described IPA and DEG are copolymerized in the warp yarn in the above-described specific amounts.

In the present invention, preferably, the copolymerization amount of IPA is in a range of 1.1 to 1.6 mol % of the total amount of carboxylic acids, and the copolymerization amount of DEG is in a range of 2.2 to 3.0 mol % of the total amount of diols, and more preferably, the copolymerization amount of IPA is in a range of 1.15 to 1.45 mol % of the total amount carboxylic acids, and the copolymerization amount of DEG is in a range of 2.3 to 2.8 mol % of the total amount of diols.

Furthermore, it is preferable that the yarn for the hook-shaped engaging elements also has IPA and DEG within the above-described range of the copolymerization amount as copolymerization components. In the case of such a yarn for the hook-shaped engaging elements, the above-described effect of the present invention is further achieved to a higher degree, and in particular, the pull-out resistance of the hook-shaped engaging elements is further improved, and the inside of the thick hook-shaped engaging elements is also dyed in a deep color. Even when the engagement and the peeling are repeated, the inside of the monofilament yarn which is insufficiently dyed is not exposed by abrasion. The PET constituting the yarn for the hook-shaped engaging elements also preferably has a copolymerization amount of IPA in the range of 1.1 to 1.6 mol % of the total amount of carboxylic acids and a copolymerization amount of DEG in the range of 2.2 to 3.0 mol % of the total amount of diols, and more preferably has a copolymerization amount of IPA in the range of 1.15 to 1.45 mol % of the total amount of carboxylic acids and a copolymerization amount of DEG in the range of 2.3 to 2.8 mol % of the total amount of diols.

In the polyester-based woven hook-and-loop fastener of the present invention, the weft yarn is required to be a polyester-based yarn, that is, a polyester-based heat-fusible multifilament yarn. Specifically, it is necessary to be the multifilament yarn containing a polyester-based resin having a melting point much lower than that of PET constituting the warp yarn or the hook-shaped engaging elements. In order to lower the melting point, a PET-based or PBT-based polyester obtained by copolymerizing a large amount of copolymerization components other than terephthalic acid, ethylene glycol, and butanediol, for example, IPA, DEG, or the like is suitably used as the heat-fusible component constituting the yarn.

Further, the yarn for the loop-shaped engaging elements is also preferably a polyester yarn. In particular, from the viewpoint of excellent dyeability, flexibility, round loop formability, and loop shape retainability, a yarn made of PBT-based polyester is suitably used, and it can be a yarn made of a PET-based polyester. In addition, when the yarn for the loop-shaped engaging elements is made of a PET-based polyester, the yarn for the loop-shaped engaging elements can or cannot contain IPA or DEG as copolymerization components, as in the case of the warp yarn and the yarn for the hook-shaped engaging elements.

When the yarn for the loop-shaped engaging elements is made of a PBT-based polyester, the yarn is preferably a yarn containing polytrimethylene terephthalate in a range of 1 to 8% by weight. Even in such a case, the melting point of the heat-fusible component in the weft yarn needs to be considerably lower than that of the PBT polyester used in the loop-shaped engaging elements.

In the present invention, the PET-based multifilament yarn used as the warp yarn needs to be PET in which specific amounts of IPA and DEG are present as copolymerization components, as described above. Further, when the hook-shaped engaging elements are present, the dry heat shrinkage percentage at 200° C. of the PET-based multifilament yarn used as the warp yarn is preferably in the range of 20 to 25%. Moreover, it is preferable that the dry heat shrinkage percentage at 200° C. of the PET monofilament yarn used as the yarn for the hook-shaped engaging elements is in the range of 22.5 to 27.5%, and the dry heat shrinkage percentage at 200° C. of the monofilament yarn for the hook-shaped engaging elements is 1 to 5% higher than the dry heat shrinkage percentage at 200° C. of the multifilament yarn for warp yarn, since the effect of the present invention can be further more highly obtained.

Further, when the loop-shaped engaging elements are present, the dry heat shrinkage percentage at 200° C. of the PET-based multifilament yarn used as the warp yarn is preferably in the range of 20 to 25%. In addition, it is preferable that the dry heat shrinkage percentage at 200° C. of the polyester-based multifilament yarn used as the yarn for the loop-shaped engaging elements is in the range of 12 to 20%, and the dry heat shrinkage percentage at 200° C. of the multifilament yarn for the loop-shaped engaging elements is 5 to 10% lower than the dry heat shrinkage percentage at 200° C. of the multifilament yarn for the warp yarn, since the effect of the present invention can be further more highly obtained as in the case of the hook hook-and-loop fastener. Further, in the case of a hook-and-loop fastener where the hook-shaped engaging elements and the loop-shaped engaging elements coexist, it is preferable to satisfy both of the above conditions for the same reason.

Note that the dry heat shrinkage percentage at 200° C. defined in the present invention is a value obtained by allowing 10 yarns with 50 cm in a free state to stand in an atmosphere at 200° C. for 1 minute without applying a load, determining the difference between the length of the shrunk yarn after 1 minutes and the length of the yarn before shrunk, and dividing it by the length before shrunk, which is the average value of 10 yarns.

With respect to the dry heat shrinkage percentage, a yarn meeting the above conditions can be easily obtained by selecting the stretching conditions represented by the stretch ratio at the time of spinning and the like, and the heat treatment conditions or the like thereafter. With respect to the copolymerization amount, it can be easily obtained by polymerizing such a copolymerized PET and spinning it into a yarn, or can be easily obtained by requesting a synthetic fiber manufacturer to meet the above numerical value.

In the present invention, as the warp yarn, the copolymerized PET multifilament yarn is used. Further, regarding a thickness of the multifilament yarn constituting the warp yarn, a multifilament yarn made of 18 to 40 filaments and having a total decitex of 80 to 240 decitex is preferable, and a multifilament yarn made of 24 to 36 filaments and having a total decitex of 90 to 200 decitex is particularly preferable, in terms of the flexibility of the obtained hook-and-loop fastener.

The weft yarn is a multifilament yarn. As the thickness of the multifilament yarn constituting the weft yarn, a multifilament yarn made of 32 to 64 filaments and having a total decitex of 150 to 30) decitex is preferable, and a multifilament yarn made of 40 to 56 filaments and having a total decitex of 180 to 250 decitex is particularly preferable.

The weft yarn must contain a low-melting point polyester, that is, a heat-fusible component. Representative examples of such a multifilament yarn containing a heat-fusible component include a multifilament yarn made of a core-sheath type heat-fusible filament in which the sheath component is a low-melting point polyester (that is, a heat-fusible component). Since the weft yarn contains the heat-fusible component, the yarn for the engaging elements can be fixed to the woven base fabric, and it is not necessary to apply a polyurethane-based or acrylic-based back coating adhesive to the rear face the hook-and-loop fastener base fabric in order to prevent the yarn for the engaging elements from being pulled out from the woven base fabric as in the conventional hook-and-loop fastener.

It is also possible to fix the yarn for the engaging elements to the base fabric by using a yarn containing a heat-fusible component in the warp yarn instead of the weft yarn. However, since the yarn for the engaging elements is threaded into the base fabric in parallel to the warp yarn, the warp yarn has a far fewer position intersecting with the yarn for the engaging elements compared to the weft yarn. Therefore, when a heat-fusible yarn is used only in the warp yarn, it is difficult to firmly fix the yarn for the engaging elements to the base fabric.

Examples of the multifilament yarn made of the core-sheath type heat-fusible filament include a multifilament yarn made of a polyester-based filament having a core-sheath type cross section in which the core component does not melt under a heat treatment condition but the sheath component melts. Specifically, a representative example include a multifilament yarn made of a core-sheath type polyester filament containing, a PET polymer as a core component, a copolymerized PET or a copolymerized PBT as a sheath component, which is obtained by copolymerizing a large amount, for example, 20 to 30 mol %, of a copolymerization component represented by IPA, adipic acid, or the like to significantly lower the melting point or softening point (in the present invention, when crystals are not formed by copolymerization or the like and instead, a softening point is present, such a softening point is referred to as a melting point).

Since a dye does not reach the core component in the core-sheath state at the time of dyeing, the core component of the heat-fusible multifilament yarn made of such a polyester-based core-sheath type filament is not required to be dyeable in a deep color like the warp yarn and the yarn for the hook-shaped engaging elements. In addition, since the weft yarn is covered with the warp yarn and the yarn for the engaging elements constituting the front face of the hook-and-loop fastener base fabric and is hardly exposed to the front face of the hook-and-loop fastener base fabric, the need to have dyeability is low. Therefore, the weft yarn is preferably a multifilament yarn made of a core-sheath type composite filament in which a PET homopolymer polymerized for fibers is used as a core component as it is.

The melting point of the sheath component of the multifilament yarn made of the core-sheath type polyester-based heat-fusible filament is in the range of 130 to 210° C., and is preferably 20 to 150° C. lower than the melting point of the warp yarn, the core component, the monofilament yarn for the hook-shaped engaging elements, or the multifilament yarn for the loop-shaped engaging elements. The cross-sectional shape of the core-sheath type heat-fusible filament can be a concentric core-sheath, an eccentric core-sheath, a single-core core-sheath, or a multi-core core-sheath. A multifilament yarn made of a single core-sheath composite component is preferable.

Furthermore, regarding the proportion of the polyester-based core-sheath type heat-fusible filament in the weft yarn, particularly when all of the weft yarn is substantially formed of the core-sheath type polyester-based heat-fusible filament, that is, when the weft yarn is a multifilament yarn only made of the core-sheath type polyester-based heat-fusible filament, both the yarn for the hook-shaped engaging elements and the yarn for the loop-shaped engaging elements are firmly fixed to the base fabric, thus it is preferable.

When the filament constituting the weft yarn does not have a sheath-core cross-sectional shape but the entire fiber cross section is formed of a heat-fusible polymer, a heat-fusible polymer that has been solidified again after being melted is brittle and easily breaks, and therefore, the base fabric, when sewn or the like, easily begins to rupture at a sewing thread portion. Thus, the heat-fusible filament preferably contains a resin that is not heat-fused, and particularly preferably has the above-described sheath-core cross-sectional shape since the effect of fusing the yarns adjacent to each other is enhanced. Further, the ratio of the core component and the sheath component by weight is in the range of 85:15 to 40:60, and particularly preferably in the range of 80:20 to 60:40.

Furthermore, in order to firmly fix both the yarn for the hook-shaped engaging elements and the yarn for the loop-shaped engaging elements to the base fabric, it is preferable that the heat-fusible component used as the weft yarn is heat-fused, and at the same time, the heat-fusible multifilament yarn itself shrinks to tighten the bases of the hook-shaped engaging elements and the loop-shaped engaging elements from both sides. For this purpose, it is preferable that the polyester-based heat-fusible multifilament yarn used as the weft yarn also undergoes the heat shrinkage to some extent under the heat treatment conditions. Specifically, a yarn having a dry heat shrinkage percentage at 200° C. of 14 to 20% is preferably used, and a case in which a dry heat shrinkage percentage is 15 to 19% and a dry heat shrinkage percentage is lower by 5 to 12% than the dry heat shrinkage percentage at 200° C. of warp yarn or the yarn for hook-shaped engaging elements is particularly preferable for enhancing the pull-out resistance of the engaging elements and more highly preventing uneven shrinkage in the width direction of the hook-and-loop fastener.

The hook-shaped engaging elements are desired to have so-called hook-shape retainability and stiffness, that is, the hook shape is not extended by light force, and therefore a thick monofilament yarn is used. In the present invention, the monofilament yarn is preferably a monofilament yarn formed of a PET polymer containing the above-described copolymer component excellent in hook shape retainability in the above-described ratio and still retaining the excellent stiffness of PET.

The thickness of such a monofilament yarn for the hook-shaped engaging elements made of PET preferably has a diameter of 0.15 to 0.22 mm, and more preferably a diameter of 0.16 to 0.20 mm, in view of engaging force. Further, in order to increase the engaging force, the cross-sectional shape of the monofilament can be a variant cross-sectional shape represented by a polygonal shape-based such as a triangular shape or a quadrangular shape.

As described above, the polyester-based woven hook-and-loop fastener of the present invention can be a loop hook-and-loop fastener in which loop-shaped engaging elements are present, or can be a hook-and-loop coexisting type hook-and-loop fastener in which hook-shaped engaging elements and loop-shaped engaging elements coexist on the front face. In the case of a hook-and-loop fastener having such loop-shaped engaging elements, the yarn for the loop-shaped engaging elements used is preferably made of a PET-based or PBT-based polyester as described above, and a multifilament yarn made of a polyester which does not melt at the temperature at which the heat-fusible component of the heat-fusible multifilament yarn is heat-fused, particularly a PBT-based polyester, is preferable from the viewpoint of the touch feeling of the hook-and-loop fastener and the extent and collapse resistance of the loop-shaped engaging elements, in addition, since dyeing in a deep color can be performed under milder dyeing conditions.

When a multifilament yarn made of PET is used as the yarn for the loop-shaped engaging elements, it is preferable to use, as such a multifilament yarn, a multifilament yarn made of PET obtained by copolymerizing the same copolymerization components as those of the warp yarn at the same copolymerization ratio as that of the warp yarn.

Further, a multifilament yarn made of PBT is used as the yarn for the loop-shaped engaging elements, a multifilament yarn made of PBT containing 1 to 8% by weight of polytrimethylene terephthalate is preferably used. In such a multifilament yarn, the filaments constituting the loop-shaped engaging elements are easily loosened, and the filaments constituting the multifilament yarn are hardly cut by a loosening treatment using a card clothing or the like when such a treatment is performed, and are hardly cut even when the engagement and the peeling are repeated, and as a result, the engagement strength force is improved. Further, deep color dyeing can be carried out under mild dyeing conditions with a disperse dye.

As the thickness of the multifilament yarn constituting the yarn for the loop-shaped engaging elements, a multifilament yarn made of 6 to 12 filaments and having a total decitex of 250 to 380 decitex is preferable, and a multifilament yarn made of 7 to 10 filaments and having a total decitex of 280 to 350 decitex is particularly preferable. Further, similar to the warp yarn, the multifilament yarn for the loop-shaped engaging elements is preferably heat-shrunk under conditions for fusing the heat-fusible component of the heat-fusible multifilament yarn of the weft yarn in terms of the effect of fixing the engaging elements, and specifically, as described above, it is preferable that the dry heat shrinkage percentage at 200° C. is 12 to 20%.

As described above, the following step A, step B and step D are performed in this order to produce a woven hook-and-loop fastener from the above-described warp yarn, weft yarn, monofilament yarn for the hook-shaped engaging elements or multifilament yarn for the loop-shaped engaging elements.

[step A] a step of weaving a loop woven-fabric by, at a time of weaving the woven base fabric from the warp yarn and the weft yarn, weaving the yarn for the engaging elements parallel into the warp yarn, and at the same time, regularly raising the yarn for the engaging elements in a loop shape from the front face of the woven base fabric;

[step B] a step of guiding the loop woven-fabric to a heating region, heating at a temperature equal to or higher than a temperature at which a heat-fusible component of the polyester-based heat-fusible multifilament yarn is melted, and fixing a rising part of a loop to the woven base fabric by a melt from the polyester-based heat-fusible multifilament yarn;

[step D] a step of cutting one leg of the loop to form loops into hook-shaped engaging elements when the loop is made of a monofilament yarn.

First, the step A is described. The woven structure of the woven-fabric is preferably a plain weave obtained by using the yarn for the engaging elements as a part of the warp yarn. It is preferable that the woven structure is one where these yarns for the engaging elements woven in parallel into the warp yarn, rise up from the face of the woven base fabric in the middle of the structure, and when the yarn for the engaging elements is a monofilament yarn, it runs over one to three threads of the warp yarn and crawls in between the warp yarns while forming a loop, on the other hand, when the yarn for the engaging elements is a multifilament yarn, a loop is formed without running over the warp yarn or with allowing one thread of the warp yarn to run over and is present in parallel to the warp yarn, in terms of the appearance since the loop faces tend to face the same direction, and further, since one leg side part in the case of the loop for the hook engaging elements can be cut efficiently and surely, and furthermore, the hook-shaped engaging elements and the loop-shaped engaging elements are easily engaged.

The warp yarn preferably has a weave density after the heat treatment of 35 to 80/cm and the weft yarn preferably has a weave density after the heat treatment of 12 to 30/cm. Further, the weight percentage of the weft yarn is preferably 15 to 40% with respect to the total weight of the yarn for the hook-shaped engaging elements, the yarn for the loop-shaped engaging elements, the warp yarn, and the weft yarn constituting the hook-and-loop fastener.

Additionally, in the woven hook-and-loop fastener of the present invention, the height of the hook-shaped engaging elements, as the height after the heat treatment, is preferably 1.2 to 1.8 mm from the face of the woven base fabric, and the height of the loop-shaped engaging elements is preferably 1.9 to 3.0 mm from the face of the woven base fabric, from the viewpoint of engaging force, and further from the viewpoint of the difficulty in falling of the engaging elements.

Further, it is preferable that the density of the hook-shaped engaging elements in the hook hook-and-loop fastener is 30 to 70/cm$^2$ on the basis of the portion of the woven base fabric on which the engaging elements are present (on the basis of the position at which the engaging elements are present excluding the selvage part (a portion where there are no engaging elements)) and on the basis of the area after the heat shrinkage, the density of the loop-shaped engaging elements in the loop hook-and-loop fastener is 30 to 70/cm$^2$ on the same basis, and the total density of the hook-shaped engaging elements and the loop-shaped engaging elements in the hook-and-loop coexisting type hook-and-loop fastener is 30 to 70/cm$^2$ on the same basis. Further, in the hook-and-loop coexisting type hook-and-loop fastener, the ratio of the number of the hook-shaped engaging elements to the number of the loop-shaped engaging elements is preferably in the range of 40:60 to 60:40.

In addition, the number of the monofilament yarns for the hook-shaped engaging elements to be threaded into the hook hook-and-loop fastener is preferably about 2 to 8 threads with respect to 20 threads of warp yarns (including the monofilament yarns for the hook-shaped engaging elements), and the number of the multifilament yarns for the loop-shaped engaging elements to be threaded into the loop hook-and-loop fastener is preferably about 2 to 8 threads with respect to 20 threads of warp yarns (including the multifilament yarns for the loop-shaped engaging elements). Additionally, in the case of the hook-and-loop coexisting type hook-and-loop fastener, in the total of the monofilament yarns for the hook-shaped engaging elements and the multifilament yarns for the loop-shaped engaging elements, about 2 to 8 threads with respect to 20 threads of warp yarns is preferable (including the monofilament yarns for the hook-shaped engaging elements and the multifilament yarns for the loop-shaped engaging elements). Further, the ratio of the number of the monofilament yarns for the hook-shaped engaging elements to the number of the multifilament yarns for the loop-shaped engaging elements is preferably in the range of 40:60 to 60:40.

Note that when the loops for the hook-shaped engaging elements are formed, in order to facilitate the formation of the loops for the hook-shaped engaging elements having uniform height, a method can be used in which a plurality of metal rods are arranged and placed on the woven base fabric in parallel to the the warp yarn above the position at which the yarns for the hook-shaped engaging elements run over the warp yarns, the yarns for the engaging elements are passed over the upper part of the metal rods to form the loops, and the metal rods are pulled out from the loops after the loops are formed.

The woven-fabric for the hook-and-loop fastener thus obtained is sent to the step B, and the heat treatment is performed by melting the heat-fusible component, which is the sheath component of the core-sheath type polyester-based multifilament yarn. Preferably, as shown in FIG. 1, it is heat-treated by continuously running in a heat treatment furnace (3) in along state without winding the woven-fabric in the middle. By the heat treatment, the sheath component of the sheath-core type heat-fusible multifilament yarn constituting the weft yarn is melted, and at the same time, the monofilament yarn and the multifilament for the engaging elements are fixed to the woven base fabric by allowing the warp yarn, the yarn for the engaging elements, and the weft yarn to shrink. Further, it is preferable that the long woven-fabric for the hook-and-loop fastener running in the heat treatment furnace is allowed to run without applying much tensile force so as to allow sufficient shrinkage.

By this, an application of the back coating adhesive and a drying treatment, which have been performed in the conventional hook-and-loop fastener, are not necessary, and the above-mentioned problem in the process and the problem of properties in which the flexibility of the hook-and-loop fastener is impaired due to the back coating adhesive can be prevented. Further, the loop shape of the hook-shaped engaging elements is fixed by heat at the time of the heat treatment, and even after one leg of the loop for the hook-shaped engaging elements is cut to form the hook-shaped engaging elements in the subsequent step D, the hook shape is maintained and sufficient engagement strength can be obtained. Also, in the case of the loop-shaped engaging elements, the loop shape becomes a natural and unified shape.

The temperature at the time of the heat treatment is a temperature at which the heat-fusible component constituting the weft yarn is melted or soften but other components or yarns are not melted, and at which the monofilament yarn for the hook-shaped engaging elements and the yarn for the loop-shaped engaging elements is shape-fixed in a loop shape, which is generally used 150 to 220° C., more preferably in the range of 185 to 215° C. and further more preferably in the range of 190 to 210° C. Such a heat treatment is usually performed by running the woven-fabric for the hook-and-loop fastener in a heated furnace. Specifically, the heat treatment is completed by running so as to stay in the heating furnace for 20 to 120 seconds at a speed of 0.30 to 1.30 m/minute.

Next, when the woven hook-and-loop fastener has a loop for the hook-shaped engaging elements on the front face, one leg side part of the leg part of the loop for the hook-shaped engaging elements protruding from the front face is cut to form the hook-shaped engaging elements. However, it is preferable to perform the following step C prior to the above procedure, because it is possible to reduce the occurrence of a waving or the like in the up-and-down direction of the hook-and-loop fastener, and it is possible to further prevent the engaging elements from being pulled out from the woven base fabric due to the repetition of the engagement and the peeling.

[step C] a step of taking out the woven base fabric from the heating region of step B and pressing a rear face of the woven base fabric against a fixed surface or a roll surface in a state in which the heat-fusible component of the polyester-based heat-fusible multifilament yarn is melted.

That is, by this step C, the yarns constituting the base fabric are pressure-bonded to each other, and the heat-fusible component extruded by the pressure-bonding penetrates into the adjacent yarns to further increase the bonding force, whereby the engaging elements are firmly fixed to the base fabric. For this reason, it is possible to highly prevent the engaging elements from being pulled out from the base fabric, and it is possible to solve the waving in the up-and-down direction which is generated by the shrinkage in the heat treatment step.

As shown in FIG. 1, it is particularly preferable to perform the step C when the woven-fabric for the hook-and-loop fastener subjected to the heat treatment in the step B comes out from the heat treatment furnace (3). Therefore, an operation is performed in which the rear face of the woven base fabric (1) is pressed against a fixed surface or a roll surface (4) in a state in which the heat-fusible component constituting the weft yarn is kept melted when it comes out from the heat treatment furnace (3). FIG. 1 shows a case where an operation in which the rear face of the woven-fabric for the hook-and-loop fastener (1) is pressed against the fixed surface (4) is performed immediately after leaving the heat treatment furnace (3).

In particular, in the present invention, when the step C is performed by a method of sliding the base fabric on the fixed surface or the roll surface while pressing against the surface, the effects of solving the waving and improving the pull-out resistance of the engaging elements can be further exhibited. That is, it is particularly preferable to satisfy all of pressing the rear face of the base fabric against the fixed surface or the roll surface, preventing the loop for the engaging elements existing on a face opposite to the face to be pressed from being pushed down by the operation, and further, sliding the running base fabric on the fixed surface or the roll surface rolling at a surface speed different from the running speed of the base fabric.

In this way, the filaments constituting the warp yarn are promoted to move to a stable position by running the woven base fabric on the fixed surface or the roll surface while sliding on the surface and being pressed against the surface, and accordingly, the weft yarn settles to a natural state and a shrinkage state is uniformized. As a result, the strain of the base fabric is solved and the squeezing out of the heat-fusible component from the weft yarn is promoted.

By pressing it against such a fixed surface or roll surface, a thickness of the warp yarn, which alternately runs over and under the weft yarn with the weft yarn interposed therebetween, in the base fabric thickness direction at the position at which the warp yarn subducts most toward the rear face side, satisfies 0.94 times or less of a thickness of the warp yarn at the position at which the warp yarn floats most toward the front face side, which is described later.

In addition, as described later, it is preferable to set the tensile force applied to the base fabric to about 50 to 600 g/cm while changing the running direction of the loop woven-fabric after contacting with the fixed surface or the roll surface when the step C is performed. More preferably, a tensile force of about 100 to 400 g/cm is applied.

Particularly preferably, the step C is performed by a method of changing the running direction while pressing the loop woven-fabric against the fixed surface and sliding it on the surface, and by changing the running direction, therefore, pressing it against the fixed surface or the roll surface is easily performed and the effect of pressing and sliding is improved. In FIG. 1, the woven-fabric for the hook-and-loop fastener (1) changes its running method by 90° along the fixed surface (4).

Further, the step C is preferably carried out at the time when the base fabric is still kept in a high temperature state by the heat applied in the step B (for example, a state in which the heat-fusible component of the polyester-based heat-fusible multifilament yarn is not fixed), following the step B, without once cooling the base fabric taken out from the step B, that is, at a temperature lower than the temperature of step B by utilizing the residual heat of the step B. Even when the base fabric coming out from the step B is once cooled and then reheated, the strain of the base fabric is hardly solved and the effect of the present invention is hardly sufficiently obtained. Therefore, step C is preferably carried out immediately in the vicinity of the place where step B has been carried out, in a state where the woven-fabric for the hook-and-loop fastener coming out from step B is kept in a heated state by heating, that is, at a temperature lower than the temperature of step B and at a temperature higher than the temperature in a state where the heat-fusible component of the polyester-based heat-fusible multifilament yarn is not fixed.

It is preferable that, until the rear face is pressed against the fixed surface or the roll surface (4) after the hook-and-loop fastener woven-fabric enters the heat treatment furnace (3), the front face and the rear face thereof do not bring in contact with any solid object such as a roller or a guide, and the fixed surface or the roll surface is the first contact object.

In the present invention, as the fixed surface or the roll surface (4) used in the step C, a surface having a contact length with the rear face of the woven base fabric of 20 to 100 mm and a contact time of 2 to 10 seconds is preferable, and specific examples of the surface include a fixed surface or a roll surface made of metals, ceramics, or heat-resistant resins, as preferable materials. The surface of the fixed surface or the roll surface can be a mirror-finished state, a satin-finished state, or slightly uneven as long as the rear face of the base fabric can be pressed against. Further, a difference of running speed at the time of sliding on the fixed surface or the roll surface (in the case of the fixed surface, the speed of running thereon, and in the case of the roll surface, the difference between the running speed of the loop woven-fabric running thereon and the surface speed of the roll surface) is preferably 4 to 30 mm/second.

Note that the fixed surface or the roll surface is preferably heated to a temperature lower than the heat treatment temperature by 80 to 100° C. in order to enhance the contact effect. However, in general, the surface of the fixed surface or the roll surface can be heated by residual heat of the heat-treated woven base fabric coming out from the heat treatment furnace. As a result, the temperature of the step C is naturally lower than the heat treatment temperature of the step B. When the temperature of the step C is higher than the temperature of the step B, the waving in the up-and-down direction generated in the step B is solved, but the waving can be newly generated by the step C.

The surface against which the rear face of the base fabric is pressed can be a surface in which the surface is fixed, a roll surface whose contact surface rolls at a surface speed different from the speed of the base fabric as the base fabric runs, or a roll surface with drive which actively pulls the base fabric and rolls at the surface speed different from the speed of the base fabric. However, in the case of the roll surface, as described above, since it is preferable that difference is provided between the surface speed of the roll and the running speed of the loop woven-fabric running while being pressed against the surface, and the rear face of the loop woven-fabric is subjected to slide on the roll surface, the apparatus is complicated. Therefore, in the present invention, thus, the fixed surface as shown in FIG. 1 in which the structure is simple and the effect is surely easily obtained, is preferably used. Further, the fixed surface can also be a guide-shaped narrow surface, but is preferably a fixed surface having a contact length as described above.

In the present invention, as shown in FIG. 1, it is preferable that the woven base fabric (1) runs and is passed through the heat treatment furnace (3), the warp yarn and the weft yarn are shrunk by the heat treatment furnace (3) as described above, then it comes out from the heat treatment furnace (3), and it is continuously run on the fixed surface or the roll surface (4), whereby the woven base fabric (1) is in a tensioned state in the warp yarn direction at the time of press-bonding to the fixed surface or the roll surface (4). Preferably, a tensile force of about 50 to 600 g/cm is applied to the woven base fabric immediately after the woven base fabric passes through the fixed surface or the roll surface (4). More preferably, a tensile force of about 100 to 400 g/cm is applied.

In the case of the polyester-based woven hook-and-loop fastener of the present invention, the warp yarn alternately runs over and under the weft yarn with the weft yarn interposed therebetween, and thus, the rear face of the woven base fabric is in the state covered by the warp yarn, and the weft yarn in which the heat-fusible component is present is hardly brought in direct contact with the fixed surface or the roll surface. Thus, the melt of the heat-fusible component does not adhere directly to the surface of the fixed surface or the roll surface, whereby the occurrence of the trouble is hardly caused.

The operation of pressing the rear face of the woven-fabric for the hook-and-loop fastener (1) against the fixed surface or the roll surface (4) in a state where the heat-fusible component constituting the weft yarn is melted is preferably carried out by utilizing the residual heat at the time of the heat treatment so as to be continued to the heat treatment in the heat treatment furnace (3) as shown in FIG. 1 without once cooling the heat-treated woven-fabric for the hook-and-loop fastener, in terms of productivity and further, since the effect obtained by the [step C] can be highly expressed.

Figure 2:
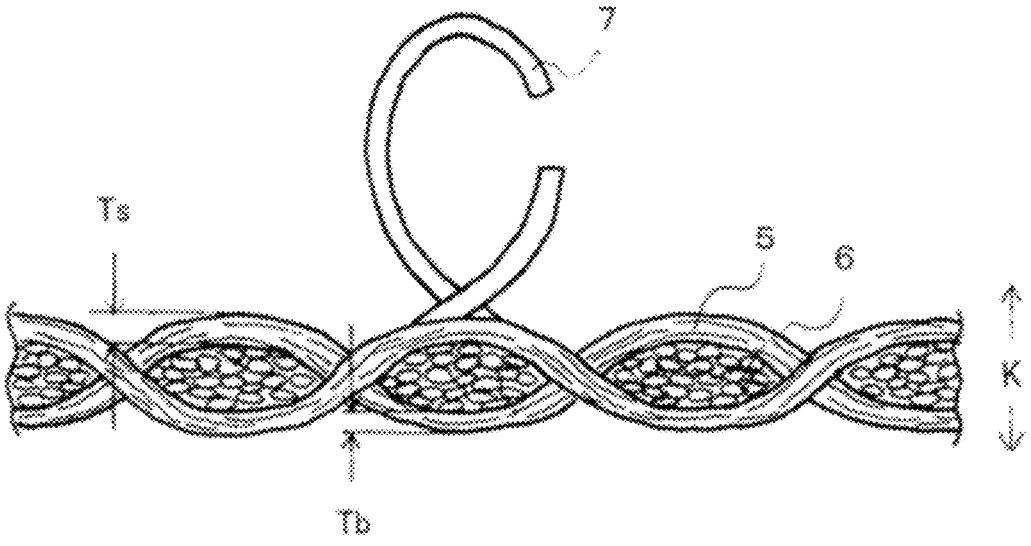
FIG. 2 is a view schematically showing a cross section in a plane parallel to the warp yarn of the woven base fabric when [step C] is performed in a suitable example of the woven hook-and-loop fastener according to the present invention.

In the method of the present invention, by performing the operation [step C] of pressing the rear face of the woven base fabric (1) against the fixed surface or the roll surface (4) in a state where the heat-fusible component is melted, as shown in FIG. 2, it is preferable that the thickness of the warp yarn in the base fabric thickness direction at the position at which the warp yarn, which alternately runs over and under the weft yarn with the weft yarn interposed therebetween, subducts most toward a rear face side (Tb) is 0.94 times or less of the thickness of the warp yarn in the same direction at the position at which the warp yarn floats most toward a front face side (Ts), that is, (Tb)/(Ts) ratio is 0.94 times or less.

In particular, in the present invention, not only by simply sliding on and pressing it against the fixed surface, as described above, but also by running and sliding it on the fixed surface while pressing it against the fixed surface, and changing the running direction, the thickness of the warp yarn, which alternately runs over and under the weft yarn with the weft yarn interposed therebetween, in the base fabric thickness direction at the the position at which the warp yarn subducts most toward the rear face side being 0.94 times or less, and preferably 0.90 times or less, of the thickness thereof at the position at which the warp yarn floats most toward the front face side is satisfied, which is particularly preferable. Note that, in FIGS. 2 and 3, K indicates the base fabric thickness direction.

However, when (Tb) is too low, the rear face of the hook-and-loop fastener base fabric is densely flattened by heat-fusion, and the flexibility and texture, which are advantages of the woven-fabric, and further, the air permeability and liquid permeability are impaired, which is not preferable. Therefore, (Tb) is preferably 0.7 times or more, that is, (Tb)/(Ts) ratio of 0.7 times or more, and particularly preferably 0.75 times or more, of (Ts).

Figure 3:
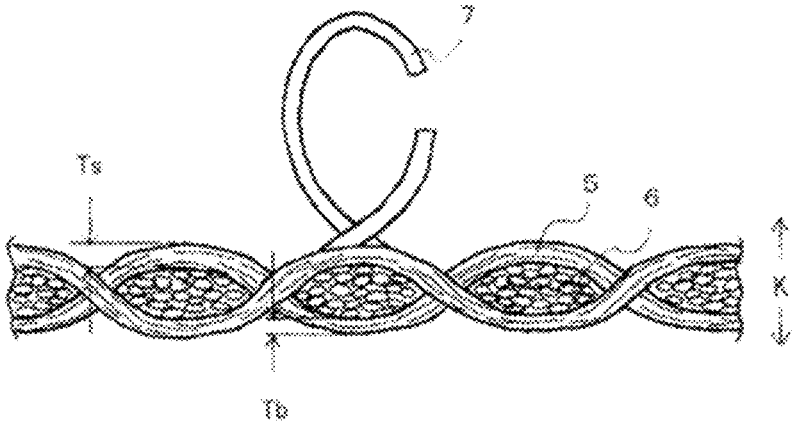
FIG. 3 is a view schematically showing a cross section in a plane parallel to the warp yarn of the woven base fabric of the woven hook-and-loop fastener when [step C] is not performed.

FIG. 2 schematically shows a cross-sectional state of the woven-fabric hook-and-loop fastener where the effect of the present invention can be further obtained by performing an operation of pressing the rear face of the woven base fabric (1) against the fixed surface or the roll surface (4) in a state where the heat-fusible component is melted, that is, the case where (Tb) is 0.94 times or less of (Ts). On the other hand, FIG. 3 is a view schematically showing the cross-sectional state of the woven-fabric hook-and-loop fastener when the operation of pressing the rear face of the woven base fabric (1) against the fixed surface or the roll surface (4) in a state where the heat-fusible component is melted is not performed. In this case, (Tb) has substantially the same value as (Ts), and the above-described (Tb) being 0.94 times or less of (Ts) is not satisfied.

Note that, even when the operation of pressing the rear face of the woven base fabric against the fixed surface or the roll surface in a state where the heat-fusible component is melted, that is, [step C], is not performed, a phenomenon in which the value of (Tb) becomes slightly smaller than the value of (Ts) due to the natural gravity of the hook-and-loop fastener during the manufacturing step of the hook-and-loop fastener woven-fabric can occur. However, the decrease is extremely slight, and (Tb) does not fall below 0.96 times (Ts), therefore, (Tb) is not 0.94 times or less of (Ts).

Next, a method for measuring (Tb) and (Ts) of warp yarn, which alternately runs over and under the weft yarn with the weft yarn interposed therebetween, is described.

First, an area on the front face on which the engaging elements are present and which is less affected by the engaging elements is selected, and the hook-and-loop fastener is cut in parallel to the warp yarn so as to cut the central part of the bulge of the warp yarn using a safety razor blade for shaving as a cutting apparatus.

Next, the resulting cross section is photographed with 200 times magnification. FIG. 2 schematically shows a photograph of the cut part obtained as a result. From this photograph, three points where the warp yarn subducts most toward the rear face side are arbitrarily selected, three points where the warp yarn floats most toward the front face side are also arbitrarily selected, and the thicknesses in the base fabric direction at the respective points is measured. The same measurement is performed at arbitrary 10 points of the hook-and-loop fastener, and the thicknesses in the base fabric thickness direction at the respective points are measured.

Among the 30 measured values of the thicknesses of the warp yarn in the base fabric thickness direction at the point where the warp yarn subducts most toward the rear face side and the 30 measured values of the thicknesses of the warp yarn in the base fabric thickness direction at the point where the warp yarn floats most toward the front face side, as measured, 5 measured valued in order from the highest value and 5 measured value in order from the lowest value are removed, and the average value of the remaining 20 values is obtained. The obtained average values are each the thickness (Tb) of the warp yarn in the base fabric thickness direction at the position where the warp yarn subducts most toward the rear face side and the thickness (Ts) of the warp yarn in the base fabric thickness direction at the position where the warp yarn floats most toward the front face side.

Note that even when the hook-and-loop fastener woven base fabric is pressed against the fixed surface or the roll surface at the time when the heat-fusible component of the weft yarn is kept in a melted state, not all the positions of the warp yarn present on the rear face of the hook-and-loop fastener woven-fabric, which is subducted most toward a rear face side, are pressed against the fixed surface or the roll surface. Among these, there sometimes exists a position where the thickness (Tb) of the rear face side of the warp yarn is hardly different from the thickness (Ts) of the front face side without being pressed against the fixed surface or the roll surface. However, in the present invention, such a position is also included in the arbitrarily selected positions. Therefore, it can be said that (Tb)/(Ts) ratio specified in the present invention is an average value obtained including these points.

On the other hand, FIG. 3 is a view in the case where the hook-and-loop fastener woven base fabric is not pressed against the fixed surface or the roll surface as described above. In the case of FIG. 3, that is, in the case where (Tb) and (Ts) are substantially the same value, the effect obtained by using the step C, that is, the effect of reducing the generation of the waving or the like of the hook-and-loop fastener in the up-and-down direction and the effect of further highly preventing the engaging elements from being pulled out from the woven base fabric by the repetition of the engagement and the peeling, cannot be obtained.

In the present invention, the ratio of (Tb) to (Ts) depends mainly on the pressing strength at the time of pressing the hook-and-loop fastener base fabric against the fixed surface or the roll surface, and therefore the value can be freely changed by running the hook-and-loop fastener base fabric on the fixed surface or the roll surface in a state with the tensile force applied, and preferably by sliding it on the surface while pressing the base fabric against the surface, and further, as shown in FIG. 1 by the pulling force of the base fabric, the degree of changing the running direction, the temperature of the basic fabric or the like at the time of changing the running direction along the fixed surface or the roll surface.

Note that, in the present invention, when the rear face of the hook-and-loop fastener woven base fabric is pressed against the fixed surface or the roll surface at the time when the heat-fusible component constituting the weft yarn is kept in a melted state, it is preferable that the front face side of the hook-and-loop fastener woven base fabric where the loop for the engaging elements of the hook-and-loop fastener is present is not pressed against the fixed surface or the roll surface. That is, when an operation that the hook-and-loop fastener woven base fabric is sandwiched between rolls and the hook-and-loop fastener base fabric is pressed from above and below is performed, the loop for engaging elements standing upright on the front face of the woven base fabric is pushed down by the pressing from above and fixed to the front face of the woven base fabric in this state, so that the engaging ability as the hook-and-loop fastener is reduced and the appearance of the hook-and-loop fastener is also deteriorated. Further, when both of the front face side and the rear face side of the hook-and-loop fastener woven base fabric are pressed against the fixed surface or the roll surface, (Tb) and (Ts) become substantially equal to each other, and the (Tb)/(Ts) ratio defined in the present invention cannot satisfy 0.94 or less.

Next, the thus-obtained woven-fabric having the loop for the hook-shaped engaging elements on the front face is sent to the step D when the loop for the engaging elements is a loop for the hook-shaped engaging elements, and in the step D, a one side part of the loop for for the hook-shaped engaging elements is cut. The cutting apparatus used is preferably a cutting apparatus having a structure for cutting one leg of the loop for the hook-shaped engaging elements of the woven base fabric for the hook hook-and-loop fastener or the woven base fabric for the hook-and-loop coexisting type hook-and-loop fastener running in the warp yarn direction by reciprocating motion of a movable cutting blade between two fixed blades. The woven-fabric in which the one leg of the loop for the hook-shaped engaging elements is cut is used as a hook hook-and-loop fastener or a hook-and-loop coexisting type hook-and-loop fastener.

In particular, in the present invention, the waving of the hook-and-loop fastener base fabric in the up-and-down direction is solved by performing the step C. Therefore, in the step D, a position of one leg of the loop for the hook-shaped engaging elements at a constant height can be easily cut. As a result, a hook hook-and-loop fastener having a constant cut position, that is, a constant engaging force, is obtained.

The polyester-based woven hook-and-loop fastener thus-obtained is preferably dyed. The dyeing is preferably carried out by high temperature and high pressure dyeing using a disperse dye, which is employed in dyeing of polyester-based fiber products. That is, the following method is preferably performed: the polyester-based woven hook-and-loop fastener of the present invention is wound into a roll shape in a long state, specifically, the hook-and-loop fastener having a length of 50 to 300 m is wound into a roll shape, the roll shaped product is placed on a partition plate, a plurality of the partition plates on which the roll shaped products are placed are stacked on the up-and-down direction and inserted into a dyeing vessel, and a dye liquid is circulated in the vessel to bring the hook-and-loop fastener into contact with the dye liquid.

Specific dyeing conditions are preferably, for example, dyeing at about 120 to 140° C. and for about 20 to 120 minutes. The type of the disperse dye used for dyeing is not particularly limited, and any disperse dye conventionally used for dyeing polyester fibers can be used. Examples of the disperse dye include nitro-based, styryl-based, and methine-based in addition to monoazo-based, diazo-based, and anthraquinone-based.

A waving in the up-and-down direction can be solved by performing [step C] in the polyester-based hook-and-loop fastener of the present invention, when such a hook-and-loop fastener is wound into a roll shape, a wound product (roll-shaped product) having a uniform interval between the hook-and-loop fastener and the surrounding hook-and-loop fastener, that is, a uniform interval between the overlapping hook-and-loop fasteners, can be obtained. When the hook-and-loop fastener wound at such a uniform interval is dyed in a wound state, since the interval is uniform, the dyed hook-and-loop fastener that is uniformly brought into contact with the dyeing liquid (that is, the drift of the dyeing liquid is small), and that is uniformly dyed, that is, has less dyeing unevenness, is obtained. Additionally, the PET yarn used as the warp yarn is dyed in a deep color by a disperse dye, compared to the general PET yarn. Further, the dyeing with a disperse dye is carried out at a high temperature and a high pressure for a long period of time as described above, and at this time, the hook-and-loop fastener of the present invention has characteristics that a new waving is hardly generated.

As described above, the polyester-based woven hook-and-loop fastener of the present invention is extremely excellent in dyeability. Specifically, when the polyester-based woven hook-and-loop fastener of the present invention is cut, both the warp yarn and weft yarn appearing on the cut surface are dyed in a deep color. Therefore, the inside of the yarn which is whitish and insufficiently dyed is not exposed to the cross section.

As described above, the woven hook-and-loop fastener having the engaging elements obtained by carrying out the steps A, B and D in this order, preferably carrying out the step C between the steps B and D, and using the yarn made of PET copolymerized with specific amounts of IPA and DEG as the warp yarn, the bases of the engaging elements are firmly fixed to the woven base fabric, the engaging elements are hardly pulled out from the woven base fabric even when the engagement and the peeling are repeated, the base fabric is excellent in flexibility although the engaging elements are hardly pulled out from the base fabric, and the base fabric is dyed in a deep color by the penetration of the disperse dye into the inside of the fiber by high temperature and high pressure dyeing with the dye, and the cross section appearing by cutting the hook-and-loop fastener is also dyed in a deep color. Further, the waving in the up-and-down direction which is usually generated in the heat treatment step of the step B and the subsequent dyeing step is solved by the step C, the variation of the engaging force is small, only one leg of the hook-shaped engaging elements can be surely cut, and the fixing of the engaging elements to the woven-fabric is further strengthened.

Therefore, the polyester-based woven hook-and-loop fastener of the present invention has an extremely high value as the pull-out force of the hook-shaped engaging elements from the base fabric. In the present invention, with respect to the pull-out force of the hook-shaped engaging elements from the base fabric, since the warp yarn has a specific copolymerization component, and the heat-fusible yarn also has a specific copolymerization component, the affinity of both is high, and as a result, the warp yarn and the heat-fusible yarn are firmly bonded. Further, all of the hook-and-loop fastener constituting yarns are heat-shrinkable yarns, whereby the bases of the engaging elements are firmly tightened, and further preferably, the hook-shaped engaging elements is also a yarn having the same specific copolymer component, whereby the bases of the hook-shaped engaging elements are fixed by fusion of the molten resin from the heat-fusible component having high affinity. In addition, by the operation of pressing the rear face of the woven base fabric against the fixed surface or the roll surface in a state where the heat-fusible component is melted, which is performed after the heat treatment, the bonding force between the heat-fusible component and the yarn for the engaging elements is further enhanced, therefore, an extremely high pull-out force of the hook-shaped engaging elements is achieved.

Note that the pull-out force of the hook-shaped engaging elements referred to herein is a value obtained by measuring the maximum strength when the hook-shaped engaging elements are pulled out from the base fabric of the hook-and-loop fastener. Further, in the case of a hook-and-loop coexisting type hook-and-loop fastener, it means the value of the pull-out force of the hook-shaped engaging elements. In the present invention, arbitrary ten of the hook-shaped engaging elements were evenly selected, their pull-out forces were measured, and the average value thereof was adopted.

The polyester-based woven hook-and-loop fastener of the present invention can be used in the application field in which conventional general woven hook-and-loop fasteners are used. They can be used in a wide range of fields, such as clothes, shoes, bags, hats, gloves, sphygmomanometers, supporters, binding bands for packing, binding tapes, various toys, fixation of civil engineering and construction sheets, fixation of various panels and wall materials, fixation of electrical parts, assembly/disassembly storage boxes and packing cases, small articles, and curtains. Particularly, they are suitable for the application fields in which the flexibility is required and the hook-and-loop fastener is attached to a fabric or sheet by sewing, for example, fields, such as clothes, shoes, bags, hats, gloves, and supporters.

In particular, it is suitable for polyester-based fiber products that are dyed with a disperse dye after a hook-and-loop fastener is attached thereto, and is suitable for applications in which the woven hook-and-loop fastener of the present invention is attached to the polyester-based fiber product by sewing or the like, and then the fiber product is dyed with a disperse dye simultaneously with the hook-and-loop fastener, that is, applications of piece dyeing. Moreover, the polyester-based woven hook-and-loop fastener of the present invention, particularly the hook hook-and-loop fastener, can be recycled after use.

EXAMPLES

Hereinafter, the present invention is described more specifically with reference to Examples. Note that, in Examples, the engaging force of a hook-and-loop fastener was measured according to JIS L 3416-2000. Further, the dry heat shrinkage percentage of the yarn used was determined by selecting arbitrary 10 yarns, measuring the dry heat shrinkage percentage of the selected yarns, and averaging the measured values. As a hook-and-loop fastener as an object to be engaged at the time of measuring the engaging force, when a hook-and-loop fastener of Examples and Comparative Examples was a hook hook-and-loop fastener, a loop hook-and-loop fastener B2790Y (manufactured by Kuraray Fastening Co., Ltd.) was used, when a hook-and-loop fastener of Examples and Comparative Examples was a loop hook-and-loop fastener, a hook hook-and-loop fastener A8693Y (manufactured by Kuraray Fastening Co., Ltd.) was used, and when a hook-and-loop fastener of Examples and Comparative Examples was a hook-and-loop coexisting type hook-and-loop fastener, the same hook-and-loop coexisting type hook-and-loop fastener was used. In addition, in the following Examples and Comparative Examples, the copolymerization ratio of IPA and DEG means a ratio with respect to the total moles of the dicarboxylic acid components of the polymerization raw materials regarding IPA, similarly, means a ratio with respect to the total moles of diol components regarding DEG.

Example 1

The following yarns were prepared as a warp yarn, a weft yarn, and a monofilament yarn for the hook-shaped engaging elements constituting the woven base fabric of the hook hook-and-loop fastener.

[Warp Yarn]

Multifilament yarn made of copolymerized PET (Copolymenzation ratio: 1.3 mol % of IPA and 2.6 mol % of DEG)

Total decitex and number of filaments: 30 of 167 dtex

Dry heat shrinkage percentage at 200° C.: 22.7%

[Weft Yarn (Multifilament-Based Heat-Fusible Yarn Made of Core-Sheath Type Composite Fiber)]

Core component: fiber grade PET

Sheath component: PET copolymerized with 25 mol % of isophthalic acid (softening point: 190° C.)

Core-sheath ratio (weight ratio): 70:30

Total decitex and number of filaments: 48 of 198 dtex

Dry heat shrinkage percentage at 200° C.: 17.1%

[Monofilament Yarn for Hook-Shaped Engaging Element]

Monofilament yarn made of non-copolymerized PET (IPA: 0 mol %, DEG: 1.3 mol %)

Diameter (before heat shrinkage): 0.19 mm

Dry heat shrinkage percentage at 200° C.: 23.1%

[Production of Hook Hook-and-Loop Fastener]

Using the warp yarn, the weft yarn, and the monofilament yarn for the hook-shaped engaging elements, a plain woven was used as a woven structure, and the monofilament yarn for the hook-shaped engaging elements was threaded in parallel to the warp yarn at a ratio of one thread per four threads of the warp yarn so as to have the weave density (after the heat shrinkage treatment) of 55 threads of warp yarn/cm and 18.9 threads of weft yarn/cm and so as to alternately run over and under five threads of the weft yarn and then alternately run over three threads of the warp yarn, thus a loop was formed on the base fabric so as to form a loop at the running-over position. Note that, when the loop for the hook-shaped engaging elements was formed, the method was used, in which a plurality of metal rods were arranged and placed on the woven base fabric in parallel to the the warp yarns on a position at which the yarn for the hook-shaped engaging elements run over the warp yarn, the yarns for the engaging elements were passed over the upper part of the metal rods to form the loops, and the metal rods were pulled out from the loops after the loops were formed.

A tape for the hook hook-and-loop fastener woven under the above conditions was subjected to a heat treatment by running in a heat treatment furnace for 60 seconds at a temperature of 200° C. at which only the sheath component of the weft yarn was heat-melted and the warp yarn, the monofilament yarn for the hook-shaped engaging elements, and the core component of the weft yarn were not heat-melted, so that the weft yarn, the weft yarn, and the monofilament yarn for the hook-shaped engaging elements were heat shrunk. As a result, the tape was shrunk by 11% in the weft yarn direction, and the sheath component was melted to fuse yarns existing in the vicinity.

With the heat-fusible component still in a melted state, as shown in FIG. 1, on a stainless steel fixed surface having a mirror-finished surface placed in the immediately vicinity of the outlet of the heat treatment furnace, the woven-fabric tape for the hook hook-and-loop fastener was slid, and run in a state with a tensile force of 300 g/cm applied after passing through the fixed surface, using the residual heat from the heat treatment step, that was, at a temperature equal to or lower than a temperature of the heat treatment step, the rear face of the tape was pressed against the fixed surface for 5 seconds, and the running direction was bent by 90° along the surface. The obtained woven-fabric was cooled, and one leg part of the loop for the hook-shaped engaging elements was cut to form hook-shaped engaging elements. Note that the step of weaving the woven-fabric, the step of the heat treatment, and further, to the step of cutting one leg were continuously performed without winding.

As a result, no waving was observed in the up-and-down direction of the hook-and-loop fastener in the heat treatment step at all. As a result, cutting of one leg part of the hook-shaped engaging elements could be performed without any problem, and only one leg of each hook-shaped engaging elements was completely cut to maintain the hook shape.

The density of the hook-shaped engaging elements of the obtained woven-fabric for the hook hook-and-loop fastener was 45/cm$^2$, and further, the height of the the hook-shaped engaging elements from the face of the woven base fabric was 1.5 mm.

The thickness (Tb) of the warp yarn in the base fabric thickness direction at the position at which the warp yarn subducts most toward the rear face side and the thickness (Ts) of the warp yarn in the base fabric thickness direction at the position at which the warp yarn floats most toward the front face side, of the hook hook-and-loop fastener were measured, and (Tb)/(Ts) was 0.89.

Next, the pull-out force of the hook-shaped engaging elements of this hook-and-loop fastener was measured and was 9.34 N, and it was found to be extremely excellent in pull-out resistance. In addition, the hook-and-loop fastener was excellent in flexibility, and further, there was no occurrence of the single yarn breakage or the fluffing of the warp yarn, and when the hook-and-loop fastener was attached to the fabric by sewing, the stiffness of the fabric was not largely impaired, and it was suitable as a fastener for clothes. Further, to observe the presence or absence of a waving in the up-and-down direction, the hook-and-loop fastener was arranged and placed on a flat glass plate in parallel, and as a result of the observation, no waving was observed.

Additionally, the engaging force of the hook hook-and-loop fastener was measured. The initial engaging force was 13.2 N/cm$^2$ in shear strength and 1.18 N/cm in peel strength, and the engaging force after 1000 times of engagement and the peeling was 12.8 N/cm$^2$ in shear strength and 1.12 N/cm in peel strength. Even after the engagement and the peeling were repeated 1000 times, the hook-shaped engaging elements pulled out from the front face of the hook hook-and-loop fastener were not observed, and it was found that the hook hook-and-loop fastener was extremely excellent in spite of the absence of the back coating layer.

Further, the hook hook-and-loop fastener was dyed with a disperse dye. The hook hook-and-loop fastener dyed in a deep color of a deep red color was obtained, the dyeability was excellent, and the waving in the up-and-down direction was not generated during dyeing. Further, when the hook-and-loop fastener was cut so as to cross the warp yarn, the cross section was uniformly dyed in a deep color. The presence or absence of waving of the hook-and-loop fastener after dyeing was also observed, and no waving was found.

Examples 2 to 3 and Comparative Examples 1 to 2

A hook hook-and-loop fastener was produced in the same manner as in Example 1, except that the multifilament yarn used as the warp yarn in Example 1 was changed to the following multifilament yarns.

[Warp Yarn Used in Example 2]

Multifilament yarn made of copolymerized PET (Copolymerization ratio: 1.1 mol % of IPA and 2.2 mol % of DEG)

Total decitex and number of filaments: 30 of 167 dtex

Dry heat shrinkage percentage at 200° C.: 21.4%

[Warp Yarn Used in Example 3]

Multifilament yarn made of copolymerized PET (Copolymerization ratio: 1.8 mol % of IPA and 3.2 mol % of DEG)

Total decitex and number of filaments: 30 of 167 dtex

Dry heat shrinkage percentage at 200° C.: 22.6%

[Warp Yarn Used in Comparative Example 1]

Multifilament yarn made of copolymerized PET (Copolymerization ratio: 0.8 mol % of IPA and 1.8 mol % of DEG)

Total decitex and number of filaments: 30 of 167 dtex

Dry heat shrinkage percentage at 200° C.: 22.7%

[Warp Yarn Used in Comparative Example 2]

Multifilament yarn made of copolymerized PET (Copolymerization ratio: 2.5 mol % of IPA and 3.9 mol % of DEG)

Total decitex and number of filaments: 30 of 167 dtex

Dry heat shrinkage percentage at 200° C.: 23.1%

The properties of the hook hook-and-loop fastener obtained in the above Examples and Comparative Examples are shown in Table 1 below Note that, in the hook hook-and-loop fastener of Comparative Example 2, it was found that the single yarn breakage and the fluffing occurred in the weaving step, and thus a commercially valuable hook-and-loop fastener was not obtained. Therefore, the subsequent steps were not performed.

With respect to the engaging forces of the obtained three kinds of hook hook-and-loop fasteners other than Comparative Example 2, the engaging force of Comparative Example 1 was inferior in the engaging force after 1000 times of repeating of the engagement and the peeling. It had almost the same engaging force as that of Example 1 except that pulling out of the hook-shaped engaging elements from the front face of the hook-and-loop fastener after repeating the engagement and the peeling 1000 times was slightly observed. Comparative Example 1 was slightly inferior in flexibility, and Examples 2 and 3 both had excellent flexibility.

In the above table, with respect to cutting of the one leg of the hook-shaped engaging element, the case where only one leg of almost all the engaging elements was completely cut was evaluated as A, and the case where the engaging elements in which one leg was not cut or the engaging elements in which the cut state was incomplete were slightly observed was evaluated as B. Further, with respect to the occurrence of the single filament breakage or the fluffing in the hook-and-loop fastener, the case where it was not occurred at all was evaluated as A, the case where it occurred slightly but did not significantly impair the commercial value was evaluated as B, and the case where the commercial value was lost due to the occurrence of the single yarn breakage or the fluffing was evaluated as C. In addition, with respect to the dyeability, a sample which could be uniformly dyed in a deep color into the cross section as that in Example 1 was evaluated as A, and a sample which was found to be undyed in the cross section was evaluated as C.

TABLE 1

| | | Example 2 | Example 3 | Comparative Example 1 | Comparative Example 2 |
|---|---|---|---|---|---|
| Copolymerization Ratio (mol %) | IPA | 1.1 | 1.8 | 0.8 | 2.5 |
| | DEG | 2.2 | 3.2 | 1.8 | 3.9 |
| Pull-out Force of Engaging Elements (N) | | 8.73 | 9.32 | 7.6 | Not Measured |
| Cutting of One Leg of Engaging Element | | A | A | A | Not Performed |
| Occurrence of Single Filament Breakage or Fluffing | | A | B | A | C |
| Tb/Ts | | 0.90 | 0.89 | 0.92 | Not Performed |
| Dyeability | | A | A | C | Not Performed |

From the above results, it is found that the hook hook-and-loop fastener using the multifilament yarn made of the copolymerized PET in which the copolymerization amount of IPA is in a range of 1.0 mol % to 2.0 mol % and the copolymerization amount of DEG is in a range of 2.0 mol % to 3.5 mol % as the warp yarn is excellent in the pull-out resistance of the engaging elements, excellent in the dyeability, and further excellent in the flexibility and the engaging force. On the other hand, in the case of the copolymerized PET which is out of the above-described range, it is found that there are disadvantages such as the occurrence of the single yarn breakage and the fluffing in the weaving step, and the poor pull-out resistance, dyeability and engaging force of the engaging elements.

Comparative Example 3

A hook hook-and-loop fastener was produced in the same manner as in Comparative Example 1, except that an operation in which the rear face side of the hook-and-loop fastener was pressed against the stainless steel fixed surface placed in the immediately vicinity of the outlet of the heat treatment furnace while the heat-fusible multifilament yarn after the heat treatment was kept in melted state in Comparative Example 1 was not performed, and it was taken up by a roller after cooling.

When the obtained hook hook-and-loop fastener was arranged and placed on a horizontal glass plate, a large waving in the up-and-down direction was observed in some places, and further, the hook-shaped engaging elements in which the base of one leg was not cut accurately and remained in a loop shape, both legs were cut such that the hook shape was not formed, and one leg was cut only partway were found in some places among them. Further, as a result of measuring the pull-out force of the hook-shaped engaging elements, it was found that the value was 6.9 N, which was significantly inferior to that of Example 1 and also inferior to that of Comparative Example 1.

The thickness (Tb) of the warp yarn in the base fabric thickness direction at the position at which the warp yarn subducts most toward the rear face side and the thickness (Ts) of the warp yarn in the base fabric thickness direction at the position at which the warp yarn floats most toward the front face side, of the hook hook-and-loop fastener were measured, and (Tb)/(Ts) was 0.97.

Further, the engagement and the peeling of the hook hook-and-loop fastener with the loop hook-and-loop fastener were repeated 1000 times. More the hook-shaped engaging elements pulled out from the woven base fabric and protruded from the front face of the hook-and-loop fastener were observed compared to those in Comparative Example 1.

When this hook hook-and-loop fastener was dyed, the cross section was not sufficiently dyed, and further, color unevenness was generated. Uneven shrinkage of the hook-and-loop fastener newly occurred during the dyeing step, a light waving in the up-and-down direction was frequently generated.

Example 4

A hook hook-and-loop fastener was produced in the same manner as in Example 1, except that the monofilament yarn for the hook-and-loop fastener used in Example 1 was changed to a monofilament yarn made of the following copolymerized PET. Note that, in the case of this hook-and-loop fastener, the single yarn breakage or the fluffing was not occurred in the weaving step.

[Monofilament Yarn for Hook-Shaped Engaging Element]
Monofilament yarn made of copolymerized PET
(IPA: 1.3 mol %. DEG: 2.6 mol %)
Diameter (before heat shrinkage): 0.19 mm
Dry heat shrinkage percentage at 200° C.: 23.6%

(Tb)/(Ts) of the obtained hook hook-and-loop fastener was 0.88. Further, in this hook hook-and-loop fastener, only one leg of each of the hook-shaped engaging elements was completely cut, and a uniform hook shape was maintained. Next, as a result of measuring the pull-out force of the hook-shaped engaging elements of this hook-and-loop fastener, it was 10.27 N, and it was found that the pull-out resistance was more excellent than that of Example 1. Further, this hook-and-loop fastener was more excellent in flexibility than that of Example 1. When the hook-and-loop fastener was attached to the fabric by sewing, the stiffness of the fabric was less impaired than in Example 1, and the fabric was extremely suitable as a fastener for clothes. In addition, the stiff hook-shaped engaging elements were more flexible than those of Example 1, and from this point, it was felt that the hook-and-loop fastener was flexible.

Further, to observe the presence or absence of a waving in the up-and-down direction, the hook-and-loop fastener was arranged and placed on a flat glass plate in parallel, and as a result of observation, no waving was observed as that of Example 1.

Further, the engaging force of the hook hook-and-loop fastener was measured. The initial engaging force was 14.1 N/cm$^2$ in shear strength and 1.21 N/cm in peel strength, and the engaging force after 1000 times of the engagement and the peeling was 13.6 N/cm$^2$ in shear strength and 1.18 N/cm in peel strength. Even after the engagement and the peeling were repeated 1000 times, the hook-shaped engaging elements pulled out from the front face of the hook hook-and-loop fastener were not observed at all, and it was found that the bases of the hook hook-and-loop fasteners were further firmly fixed. As above, it was found that the hook-and-loop fastener of this Example was extremely excellent as a hook hook-and-loop fastener in spite of the absence of the back coating layer.

Moreover, the hook hook-and-loop fastener was dyed with a disperse dye in the same manner as in Example 1. The hook hook-and-loop fastener dyed vividly in a deep color of a deep red color was obtained, the dyeability was excellent, and no waving in the up-and-down direction was generated during the dyeing. Further, when it was cut across the warp yarn, the section was uniformly dyed in a deep color. The presence or absence of waving in the hook-and-loop fastener after the dyeing was also observed, and no waving was found.

Examples 5 to 6 and Comparative Examples 4 to 6

A hook hook-and-loop fastener was produced in the same manner as in Example 1, except that the multifilament yarn used as the warp yarn in Example 1 was changed to the following multifilament yarns.

[Warp Yarn Used in Example 5]
Multifilament yarn made of copolymerized PET
(Copolymerization ratio: 1.1 mol % of IPA and 3.2 mol % of DEG)
Total decitex and number of filaments: 30 of 167 dtex
Dry heat shrinkage percentage at 200° C.: 22.6%

[Warp Yarn Used in Example 6]
Multifilament yarn made of copolymerized PET
(Copolymerization ratio: 1.8 mol % of IPA and 2.2 mol % of DEG)
Total decitex and number of filaments: 30 of 167 dtex
Dry heat shrinkage percentage at 200° C.: 22.0%

[Warp Yarn Used in Comparative Example 4]
Multifilament yarn made of copolymerized PET
(Copolymerization ratio: 1.3 mol % of IPA and 1.7 mol % of DEG)
Total decitex and number of filaments: 30 of 167 dtex
Dry heat shrinkage percentage at 200° C.: 21.5%

[Warp Yarn Used in Comparative Example 5]
Multifilament yarn made of copolymerized PET
(Copolymerization ratio: 0.8 mol % of IPA and 2.6 mol % of DEG)
Total decitex and number of filaments: 30 of 167 dtex
Dry heat shrinkage percentage at 200° C.: 21.9%

[Warp Yarn Used in Comparative Example 6]
Multifilament yarn made of non-copolymerized PET
(Copolymerization ratio: 0 mol % of IPA and 1.3 mol % of DEG)

Total decitex and number of filaments: 30 of 167 dtex

Dry heat shrinkage percentage at 200° C.: 22.1%

The properties of the five types of hook hook-and-loop fasteners obtained in the above Examples and Comparative Examples are shown in Table 2 below. Note that it was found that, regarding the hook hook-and-loop fastener of Comparative Example 4, a commercially valuable hook-and-loop fastener was not obtained due to occurrence of the single yarn breakage and the fluffing in the weaving step. Therefore, the subsequent steps were not performed. With respect to the engaging forces of the four kinds of hook hook-and-loop fasteners except for the hook hook-and-loop fastener of Comparative Example 4, those of Comparative Example 5 and Comparative Example 6 were inferior in both of the initial engaging force and the engaging force after repeating the engagement and the peeling 1000 times. The engaging force was almost the same as that of Example 1, except that pulling out of the hook-shaped engaging elements from the front face of the hook-and-loop fastener after 1000 times of repeating of the engagement and the peeling was slightly observed. Note that, in the table, the evaluation (A, B, C) of the occurrence of the single yarn breakage and the fluffing and the dyeability is based on the same criteria as described in Table 1.

TABLE 2

| | | Example 5 | Example 6 | Comparative Example 4 | Comparative Example 5 | Comparative Example 6 |
|---|---|---|---|---|---|---|
| Copolymerization Ratio (mol %) | IPA | 1.1 | 1.8 | 1.3 | 0.8 | 0 |
| | DEG | 3.2 | 2.2 | 1.7 | 2.6 | 1.3 |
| Pull-out Force of Engaging Elements (N) | | 8.57 | 8.41 | Not Measured | 7.34 | 7.12 |
| Occurrence of Single Filament Breakage or Fluffing | | A | B | C | A | A |
| Cutting of One Leg of Engaging Element | | A | A | Not Performed | A | A |
| Tb/Ts | | 0.89 | 0.89 | Not Performed | 0.90 | 0.91 |
| Dyeability | | A | A | Not Performed | B | C |

From the above results, it can be seen that when at least one of the copolymerization amount of IPA and the copolymerization amount of DEG is out of the range specified in the present invention (Comparative Examples 4 and 5), the single yarn breakage or the fluffing occurs in the weaving step, or the pull-out resistance of the engaging elements is inferior, and furthermore, the dyeability is also inferior. On the other hand, when the copolymerization amount is within the range specified in the present invention (Examples 5 and 6), it is found that these problems hardly occur. In the case of the non-copolymerized PET (Comparative Example 6) in which IPA is not copolymerized at a DEG amount at which the copolymerization component is naturally generated, it is understood that both of the pull-out resistance and the dyeability of the engaging elements are inferior.

Example 7

The following yarn was prepared as a multifilament yarn for the loop-shaped engaging elements, and a loop hook-and-loop fastener was produced by the following method using this multifilament yarn for the the loop-shaped engaging elements, the multifilament yarn for the warp yarn described in Example 1, and the multifilament yarn for the weft yarn described in Example 1.

[Multifilament Yarn for Loop-Shaped Engaging Element]

High-shrinkage multifilament yarn made of PBT blended with 5% by weight of polytrimethylene terephthalate (melting point: 220° C.)

Total decitex and number of filaments: 8 of 305 dtex

Dry heat shrinkage percentage at 200° C.: 17.3%

[Production of Loop Hook-and-Loop Fastener]

The above described warp yarn, the weft yarn and the multifilament yarn for the loop-shaped engaging elements were used, a plain weave was used as the woven structure, and the multifilament yarn for the loop-shaped engaging elements was threaded into the warp yarn in parallel at a ratio of one thread to four threads of warp yarn without running over the warp yarn so as to have the weave density (after the heat shrinkage treatment) of 55 threads of warp yarn/cm and 21 threads of weft yarn/cm, and so as to alternately run over and under five threads of the weft yarn, and then a loop was formed on the woven base fabric. In this weaving step, the single yarn breakage or the fluffing was not occurred.

The tape for the loop hook-and-loop fastener woven under the above conditions was heat-treated at 190° C. at which only the sheath component of the weft yarn was heat-melted and the warp yarn, the multifilament yarn for the loop engaging elements, and the core component of the weft yarn were not heat-melted, by running in a heat treatment furnace for 50 seconds, as in Example 1, so that the weft yarn, the weft yarn, and the multifilament yarn for the loop-shaped engaging elements were shrunk. As a result, the tape was shrunk by 10% in the weft yarn direction, and the sheath component was melted to fuse yarns existing in the vicinity.

With the heat-fusible component still in a melted state, as shown in Example 1, on a stainless steel fixed surface having a mirror-finished surface placed in the immediately vicinity of the outlet of the heat treatment furnace, the woven-fabric tape for the loop hook-and-loop fastener was slid and run, using the residual heat from the heat treatment step, the rear face of the tape was pressed against the fixed surface for 5 seconds, the running direction was bent by 90° along the surface, and the obtained woven-fabric was cooled. Note that the step of weaving the woven-fabric, the step of the heat treatment, and further, to pressing of the rear face against the fixed surface and cooling were continuously performed without winding.

As a result, the waving in the up-and-down direction of the loop hook-and-loop fastener was not observed at all in the heat treatment step. The density of the hook-shaped engaging elements of the obtained woven-fabric for the loop hook-and-loop fastener was 46/cm$^2$, and the height of the loop-shaped engaging elements from the face of the woven base fabric was 2.1 mm.

The thickness (Tb) of the warp yarn in the base fabric thickness direction at the position at which the warp yarn subducts most toward the rear face side and the thickness (Ts) of the warp yarn in the base fabric thickness direction at the position at which the warp yarn floats most toward the front face side, of the loop hook-and-loop fastener were measured, and (Tb)/(Ts) was 0.87.

Next, as a result of measuring the pull-out force of the loop-shaped engaging elements of this hook-and-loop fastener, it was 22.1 N, and it was found to be extremely excellent in pull-out resistance. Note that the pull-out force of the loop-shaped engaging elements was measured in a state where the multifilament yarn for the loop-shaped engaging elements was cut at a position where the multifilament yarn forming the loop-shaped engaging elements formed a loop, subducted under the weft yarn, and then floated on the front face of the base fabric.

In addition, this hook-and-loop fastener was excellent in flexibility, and when the hook-and-loop fastener was attached to a fabric by sewing, the stiffness of the fabric was not largely impaired, and thus it was extremely suitable as a fastener for clothes. Further, to observe the presence or absence of a waving in the up-and-down direction, the hook-and-loop fastener was arranged and placed on a flat glass plate in parallel, and as a result of the observation, no waving was observed.

Moreover, the engaging force of the loop hook-and-loop fastener was measured. The initial engaging force was 13.1 $N/cm^2$ in shear strength and 1.16 N/cm in peel strength, and the engaging force after 1000 times of the engagement and the peeling was 12.6 $N/cm^2$ in shear strength and 1.11 N/cm in peel strength. Even after the engagement and the peeling were repeated 1000 times, the loop-shaped engaging elements pulled out from the front face of the loop hook-and-loop fastener were not observed.

Further, the loop hook-and-loop fastener was subjected to a dyeing treatment with a disperse dye. The loop hook-and-loop fastener dyed vividly in a deep color of a deep red color was obtained, the dyeability was excellent, and no waving of the up-and-down direction was generated during the dyeing. Further, when the dyed loop hook-and-loop fastener was cut across the warp yarn, the cross section was uniformly dyed in a deep color. The presence or absence of a waving in the up-and-down direction after dying was observed, and no waving was found.

Comparative Example 7

A loop hook-and-loop fastener was produced in the same manner as in Example 7 except that the multifilament yarn used as a warp yarn in Example 7 was replaced with the multifilament yarn for the warp yarn used in Comparative Example 6 (copolymerization amount of IPA: 0 mol %, copolymerization amount of DEG: 1.3 mol %). Also in this case, the single yarn breakage or the fluffing was not observed in the weaving step. As a result of measuring the pull-out force of the loop-shaped engaging elements of the obtained loop hook-and-loop fastener, it was found to be 18.1 N, which was inferior to that of Example 7 in the pull-out resistance of the engaging elements. Actually, it was slightly observed that a part of the loop-shaped engaging elements was loosely pulled out from the front face of the loop hook-and-loop fastener even after the engagement and the peeling were repeated 1000 times. In addition, the flexibility was also inferior to that of Example 7, and it could not be said that it was suitable for application fields requiring high flexibility.

Further, to observe the presence or absence of a waving in the up-and-down direction of this loop hook-and-loop fastener, the hook-and-loop fastener was arranged and placed on a flat glass plate in parallel, and as a result of the observation, no waving was observed at all. When the engaging force of the loop hook-and-loop fastener was measured, the engaging force was not inferior to that of Example 7. However, when the engagement and the peeling were repeated 1000 times as described above, it was slightly observed that a part of the filaments in the multifilament yarn constituting the loop-shaped engaging elements was pulled out from the face of the hook-and-loop fastener base fabric.

Additionally, the loop hook-and-loop fastener was subjected to a dyeing treatment with a disperse dye in the same manner as in Example 7. The loop hook-and-loop fastener dyed vividly in a deep color of a deep red color on the front face was obtained. However, when the loop hook-and-loop fastener was cut across the warp yarn, an insufficiently dyed portion was observed in the cross section.

Example 8

Using the warp yarn and the weft yarn described in Example 1, the monofilament yarn for the hook-shaped engaging elements described in Example 4 (copolymerization amount of IPA: 1.3 mol %, copolymerization amount DEG: 2.6 mol %), and the multifilament yarn for the loop-shaped engaging elements described in Example 7 (PBT blended with 5% by weight of polytrimethylene terephthalate), a hook-and-loop coexisting type hook-and-loop fastener was produced by the following method.

Production of Hook-and-Loop Coexisting Type Hook-and-Loop Fastener

A plain weave was used as the woven structure, the weave density (after the heat shrinkage treatment) was 55 threads of warp yarn/cm and 18.5 threads of weft yarn/cm, and the multifilament yarn for the loop-shaped engaging elements or the monofilament yarn for the hook-shaped engaging elements was used at a ratio of one thread to four threads of warp yarn, and in the case of the multifilament yarn for the loop-shaped engaging elements, after three threads of weft yarn were alternately run over and under, one tread of warp yarn was run over, and then it was threaded into the warp yarn in parallel, a loop was formed on the base fabric so as to form a loop at the position at which it run over one warp yarn, and in the case of the monofilament yarn for the hook-shaped engaging elements, after three threads of weft yarn were alternately run over and under, three threads of warp yarn were run over, and then a loop was formed on the base fabric so as to form a loop at the running-over position. In this weaving step, the single yarn breakage or the fluffing was not occurred.

At this time, the multifilament yarn for the loop-shaped engaging elements and the monofilament yarn for the hook-shaped engaging elements were alternately woven so as to be each continuously present in a unit of two threads. Note that when the loop for the hook-shaped engaging elements was formed, a method was used in which a plurality of metal rods were arranged and placed on the woven base fabric in parallel to the the warp yarns on a position at which the yarn for the hook-shaped engaging elements run over the warp yarn, the yarns for the engaging elements were passed over the upper part of the metal rods to form the loops, and the metal rods were pulled out from the loops after the loops were formed, as in Example 1.

The tape for the hook-and-loop coexisting type hook-and-loop fastener woven was subjected to a heat treatment by running in a heat treatment furnace for 60 seconds at a temperature of 205° C. at which only the sheath component of the weft yarn was heat-melted and the warp yarn, the yarn for the engaging elements, and further, the core component of the weft yarn were not heat-melted. Next, with the heat-fusible component still in a melted state, as shown in FIG. 1, on a stainless steel fixed surface having a mirror-finished surface placed in the immediately vicinity of the outlet of the heat treatment furnace, the woven-fabric tape for the hook hook-and-loop fastener was slid, and run in a state with a tensile force of 300 g/cm applied after passing through the fixed surface, using the residual heat from the heat treatment step, the rear face of the tape was pressed against the fixed surface for 5 seconds, and the running direction was bent by 90° along the surface. As a result, the weft yarn, the weft yarn, and the yarn for the engaging elements were shrunk, the tape was shrunk by 11% in the weft yarn direction, and the sheath component was melted to fuse the yarns existing in the vicinity thereof. The obtained woven-fabric was cooled and subsequently one leg part of the loop for the hook-shaped engaging elements was cut to form hook-shaped engaging elements.

The density of the hook-shaped engaging elements of the obtained hook-and-loop coexisting type hook-and-loop fastener was 32/cm$^2$, the density of the loop-shaped engaging elements was 32/cm$^2$, and further, the height of the the hook-shaped engaging elements from the face of the base fabric was 2.1 mm and the height of the the loop-shaped engaging elements from the base fabric was 1.6 mm. Note that the step of weaving the woven-fabric, the step of the heat treatment, and further, to cutting of one leg of the loop for the hook-shaped engaging elements were continuously performed without winding in the middle.

As a result, regarding the obtained hook-and-loop coexisting type hook-and-loop fastener, the waving in the up-and-down direction of the hook-and-loop fastener was not observed at all in the heat treatment step, as those in Examples 1 and 2, and as a result, cutting of one leg of the hook-shaped engaging elements could be performed without any problem. The thickness (Tb) of the warp yarn in the base fabric thickness direction at the position at which the warp yarn subducts most toward the rear face side and the thickness (Ts) of the warp yarn in the base fabric thickness direction at the position at which the warp yarn floats most toward the front face side, of the hook-and-loop coexisting type hook-and-loop fastener were measured, and (Tb)/(Ts) was 0.88.

As a result of measuring the pull-out force of the hook-shaped engaging elements of this hook-and-loop fastener, it was 7.62 N, and it was found to be extremely excellent in pull-out resistance as a hook-and-loop coexisting type hook-and-loop fastener. The obtained hook-and-loop fastener was extremely excellent in flexibility, and, as that of Example 1, when the hook-and-loop fastener was attached to the fabric by sewing, the stiffness of the fabric was not largely impaired, and it was suitable as a fastener for clothes.

Further, the engaging force of the hook-and-loop coexisting type hook-and-loop fastener was measured. The initial engaging force was 10.4 N/cm$^2$ in shear strength and 1.43 N/cm in peel strength, and the engaging force after 1000 times of engagement and the peeling was 9.1 N/cm$^2$ in shear strength and 1.30 N/cm in peel strength, which was the excellent engaging force as a hook-and-loop coexisting type hook-and-loop fastener. Even after the engagement and the peeling were repeated 1000 times, the hook-shaped engaging elements or the loop-shaped engaging elements pulled out from the woven base fabric were not found.

The hook-and-loop coexisting type hook-and-loop fastener was subjected to a dye treatment with a disperse dye of a deep red color. The hook-and-loop fastener uniformly dyed vividly in a deep color of a deep red color was obtained, and it was found that the dyeability was extremely excellent. Further, the hook-and-loop fastener after dyeing was cut and the cross section was observed. The inside of the cross section was dyed in a deep color, and even when the front face of the hook-shaped engaging elements was lightly rubbed with a sand paper, the inner layer which was not dyed was not exposed. In addition, in the dyeing step, the hook-and-loop fastener was not unevenly shrunk to cause a waving in the up-and-down direction, and the pulling resistance of the hook-shaped engaging elements of the hook-and-loop fastener after dyeing was the same excellent value as that before dyeing.

Comparative Example 8

A hook-and-loop coexisting type hook-and-loop fastener was produced in the same manner as in Example 8, except that, in Example 8, the multifilament yarn for the warp yarn described in Comparative Example 6 (copolymerization amount of IPA: 0 mol %, copolymerization amount of DEG: 1.3 mol %) was used as the warp yarn and the monofilament yarn for the hook-shaped engaging elements described in Example 1 (IPA: 0 mol %. DEG: 1.3 mol %) was used as the yarn for the hook-and-loop fastener. In this weaving step, single yarn breakage or fluffing was not occurred.

The thickness (Tb) of the warp yarn in the base fabric thickness direction at the position at which the warp yarn subducts most toward the rear face side and the thickness (Ts) of the warp yarn in the base fabric thickness direction at the position at which the warp yarn floats most toward the front face side, of the obtained hook-and-loop coexisting type hook-and-loop fastener were measured, and (Tb)/(Ts) was 0.90. As a result of measuring the pull-out force of the hook-shaped engaging elements of this hook-and-loop fastener, it was 6.72 N. and it was found that it was inferior to that of Example 8. The obtained hook-and-loop fastener was slightly stiff and as compared with that of Example 1, it was not necessarily suitable for the fields of clothes for infants and sick persons where flexibility is highly required.

Note that the engaging force of the hook-and-loop coexisting type hook-and-loop fastener was the same as that of Example 8. However, some of the hook-shaped engaging elements and loop-shaped engaging elements were slightly pulled out from the woven base fabric after 1000 times repetition of the engagement and the peeling. When the hook-and-loop coexisting type hook-and-loop fastener was subjected to a dye treatment with a disperse dye of a deep red color, a product dyed in a deep red color was obtained. However, when the hook-and-loop fastener after dyeing was cut and the cross section was observed, insufficiently dyed warp yarn was observed. When the front face of the hook-shaped engaging elements was lightly rubbed with a sand paper, the inner layer which had not been dyed was exposed.

REFERENCE SIGNS LIST

1: woven base fabric
2: loop for hook-shaped engaging element
3: heat treatment furnace
4: fixed surface or roll surface
5: warp yarn
6: weft yarn
7: hook-shaped engaging element
Tb: thickness of warp yarn in base fabric thickness direction at position at which warp yarn subducts most toward rear face side
Ts: thickness of warp yarn in base fabric thickness direction at position at which warp yarn floats most toward front face side

The invention claimed is:

1. A polyester-based woven hook-and-loop fastener comprising: a woven-fabric and engaging elements, wherein the woven-fabric in which a polyethylene terephthalate-based multifilament yarn is a warp yarn and a polyester-based heat-fusible multifilament yarn is a weft yarn, is a woven base fabric, a yarn for the engaging elements made of at least one kind selected from the group consisting of a polyethylene terephthalate-based monofilament yarn and a polyester-based multifilament yarn is woven in parallel to the warp yarn into the woven base fabric, the engaging elements that are formed of the yarn for the engaging elements, that are made of at least one kind selected from the group consisting of a large number of hook shapes and loop shapes, and that rise up from a front face of the woven base fabric, exist on the front face of the woven base fabric, bases of the engaging elements are fixed to the woven base fabric by a melt-solidified material of a heat-fusible component of the polyester-based heat-fusible multifilament yarn, and the polyethylene terephthalate-based multifilament yarn is made of a copolymerized polyethylene terephthalate containing, as copolymerization components, 1.0 to 2.0 mol % of isophthalic acid with respect to a total amount of dicarboxylic acids and 2.0 to 3.5 mol % of diethylene glycol with respect to a total amount of diols.

2. The polyester-based woven hook-and-loop fastener according to claim 1, wherein, when the yarn for the engaging elements is a monofilament yarn, the engaging elements formed of the monofilament yarn are hook-shaped engaging elements, and when the yarn for the engaging elements is a multifilament yarn, the engaging elements formed of the multifilament yarn are loop-shaped engaging elements.

3. The polyester-based woven hook-and-loop fastener according to claim 1, wherein, when the yarn for the engaging elements is a monofilament yarn, the monofilament yarn is made of a copolymerized polyethylene terephthalate containing, as copolymerization components, 1.0 to 2.0 mol % of isophthalic acid with respect to a total amount of dicarboxylic acids and 2.0 to 3.5 mol % of diethylene glycol with respect to a total amount of diols.

4. The polyester-based woven hook-and-loop fastener according to claim 1, wherein, when the yarn for the engaging elements is a multifilament yarn, the multifilament yarn is made of a polyethylene terephthalate-based or polybutylene terephthalate-based polyester.

5. The polyester-based woven hook-and-loop fastener according to claim 1, wherein the woven base fabric satisfies a thickness of the warp yarn, which alternately runs over and under the weft yarn with the weft yarn interposed therebetween, in a base fabric thickness direction of the woven-fabric at a position at which the warp yarn subducts most toward a rear face side being 0.94 times or less of a thickness of the warp yarn in the base fabric thickness direction of the woven-fabric at a position at which the warp yarn floats most toward a front face side.

6. The polyester woven hook-and-loop fastener according to claim 1, wherein the polyester woven hook-and-loop fastener is dyed with a disperse dye.

7. A method for producing a polyester-based woven hook-and-loop fastener, the polyester-based woven hook-and-loop fastener comprising: a woven-fabric and engaging elements, wherein the woven-fabric in which a polyethylene terephthalate-based multifilament yarn is a warp yarn and a polyester-based beat-fusible multifilament yarn is a weft yarn is a woven base fabric, a yarn for the engaging elements made of at least one kind selected from the group consisting of a polyethylene terephthalate-based monofilament yarn and a polyester-based multifilament yarn is woven in parallel to the warp yarn into the woven base fabric, the engaging elements that are formed of the yarn for the engaging elements, that are made of at least one kind selected from the group consisting of a large number of hook shapes and loop shapes, and that rise up from a front face of the woven base fabric exist on the front face of the woven base fabric, and step A, step B, and step D described below are performed in this order, and the multifilament yarn made of a copolymerized polyethylene terephthalate containing, as copolymerization components, 1.0 to 2.0 mol % of isophthalic acid with respect to a total amount of dicarboxylic acids and 2.0 to 3.5 mol % of diethylene glycol with respect to a total amount of diols is used as the warp yarn;

[step A] a step of weaving a loop woven-fabric by, at a time of weaving the woven base fabric from the warp yarn and the weft yarn, weaving the yarn for the engaging elements parallel into the warp yarn, and at the same time, regularly raising the yarn for the engaging elements in a loop shape from the front face of the woven base fabric;

[step B] a step of guiding the loop woven-fabric to a heating region, heating at a temperature equal to or higher than a temperature at which a heat-fusible component of the polyester-based heat-fusible multifilament yarn is melted, and fixing a rising part of a loop to the woven base fabric by a melt from the polyester-based heat-fusible multifilament yam;

[step D] a step of cutting one leg of the loop to form loops into hook-shaped engaging elements when the loop is made of a monofilament yarn.

8. The method for producing the polyester-based woven hook-and-loop fastener according to claim 7, wherein, when the yarn for the engaging elements is a monofilament yarn, the monofilament yarn made of a copolymerized polyethylene terephthalate containing, as copolymerization components, 1.0 to 2.0 mol % of isophthalic acid with respect to a total amount of dicarboxylic acids and 2.0 to 3.5 mol % of diethylene glycol with respect to a total amount of diols is used.

9. The method for producing the polyester-based woven hook-and-loop fastener according to claim 7, wherein, when the yarn for the engaging elements is a multifilament yarn, the multifilament yarn made of a polyethylene terephthalate-based or polybutylene terephthalate-based polyester is used.

10. The method for producing the polyester-based woven hook-and-loop fastener according to claim 7, wherein step C described below is performed between step B and step D: [step C] a step of taking out the woven base fabric from the heating region of step B and pressing a rear face of the woven base fabric against a fixed surface or a roll surface in a state in which the heat-fusible component of the polyester-based heat-fusible multifilament yarn is melted.

11. The method for producing the polyester-based woven hook-and-loop fastener according to claim 10, wherein [step C] is performed by a method in which while pressing the rear face of the woven base fabric against the fixed surface, the woven base fabric is allowed to run while sliding on the surface and a running direction of the woven base fabric is changed on the fixed surface.

12. The method for producing the polyester-based woven hook-and-loop fastener according to claim 10, wherein [step C] is performed at a temperature lower than a temperature of [step B] by utilizing a residual heat of [step B], following [step B] without once cooling the woven base fabric taken out from [step B].

13. A method for producing a dyed polyester-based woven hook-and-loop fastener, comprising dyeing the polyester-based woven hook-and-loop fastener obtained by the method for producing the polyester-based woven hook-and-loop fastener according to claim 7 with a disperse dye.

* * * * *